US009855762B2

(12) United States Patent
Miyashita et al.

(10) Patent No.: US 9,855,762 B2
(45) Date of Patent: Jan. 2, 2018

(54) DAMPER AND INK CIRCULATION METHOD

(71) Applicant: MIMAKI ENGINEERING CO., LTD., Nagano (JP)

(72) Inventors: Eiji Miyashita, Nagano (JP); Akira Takeuchi, Nagano (JP); Tomoya Sato, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/310,788

(22) PCT Filed: May 15, 2015

(86) PCT No.: PCT/JP2015/064115
§ 371 (c)(1),
(2) Date: Nov. 14, 2016

(87) PCT Pub. No.: WO2015/174535
PCT Pub. Date: Nov. 19, 2015

(65) Prior Publication Data

US 2017/0087868 A1 Mar. 30, 2017

(30) Foreign Application Priority Data

May 16, 2014 (JP) ..... 2014-102908

(51) Int. Cl.
*B41J 2/175* (2006.01)
*B41J 2/18* (2006.01)

(52) U.S. Cl.
CPC ..... *B41J 2/17596* (2013.01); *B41J 2/1752* (2013.01); *B41J 2/17503* (2013.01);
(Continued)

(58) Field of Classification Search
CPC .... B41J 2/175; B41J 2/17503; B41J 2/17506; B41J 2/17513; B41J 2/1752; B41J 2/17523; B41J 2/17596; B41J 2/18
See application file for complete search history.

(56) References Cited

U.S. PATENT DOCUMENTS 7,556,367 B2 * 7/2009 Langford ..... B41J 2/17509 347/89
8,109,613 B2 * 2/2012 Nitta ..... B41J 2/175 347/59

(Continued)

FOREIGN PATENT DOCUMENTS

| | | |
|---|---|---|
| JP | 2009-279932 | 12/2009 |
| JP | 2011-046070 | 3/2011 |
| JP | 2011-156859 | 8/2011 |

OTHER PUBLICATIONS

"International Search Report (Form PCT/ISA/210) of PCT/JP2015/064115", dated Jul. 28, 2015, with English translation thereof, pp. 1-4.

*Primary Examiner* — Anh T. N. Vo
(74) *Attorney, Agent, or Firm* — JCIPRNET

(57) ABSTRACT

A damper and an ink circulation method capable of suppressing deposition of color materials of ink are provided. A damper is a hydraulic head difference type damper for supplying ink supplied from an ink tank of an inkjet printer by a hydraulic head difference, into a head. The damper has a supply chamber for temporarily storing ink, an ink chamber connected to the supply chamber through a connection passage and configured to supply the ink into the head, and an on-off valve. The on-off valve opens the connection passage if the ink contained in the ink chamber decreases, and blocks the connection passage if the ink contained in the ink chamber increases. A guide port for guiding the ink contained in the ink chamber to a circulation tube for
(Continued)

circulating the ink between the ink chamber and the ink tank is formed in the ink chamber.

14 Claims, 12 Drawing Sheets

(52) U.S. Cl.
CPC ..... *B41J 2/17506* (2013.01); *B41J 2/17513* (2013.01); *B41J 2/17523* (2013.01); *B41J 2/18* (2013.01)

(56) References Cited

U.S. PATENT DOCUMENTS 8,702,215 B2 * 4/2014 Kawase ..... B41J 2/17509 347/85
8,733,914 B2 * 5/2014 Ishizawa ..... B65B 3/04 347/86
9,254,669 B2 * 2/2016 Yoshida ..... B41J 2/1752

* cited by examiner

DAMPER AND INK CIRCULATION METHOD

CROSS-REFERENCE TO RELATED APPLICATION

This application is a 371 application of the International PCT application serial no. PCT/JP2015/064115, filed on May 15, 2015, which claims the priority benefits of Japan Patent Application No. 2014-102908, filed on May 16, 2014. The entirety of each of the above-mentioned patent applications is hereby incorporated by reference herein and made a part of this specification.

TECHNICAL FIELD

The disclosure relates to a damper and an ink circulation method.

BACKGROUND ART

There has been an inkjet printer having a circulation mechanism for circulating ink between a head and an ink tank by guiding ink from the head toward the ink tank when the head for ejecting ink is in a standby state (see Patent Literature 1 for instance).

CITATION LIST

Patent Literature

Patent Literature 1: JP-A-2009-279932

SUMMARY OF DISCLOSURE

Technical Problem

In the above-described circulation mechanism disclosed in PTL 1, a three-way valve is attached to an outlet of an ink tank, and a three-way valve is attached to an inlet of a damper for supplying ink from the ink tank to a head, and the three-way valves are connected by an ink supply tube for supplying ink from the ink tank to the damper by a hydraulic head difference and an ink circulation tube for guiding ink of the damper side to the ink tank side. In the circulation mechanism, a circulation pump for circulating ink between the ink tank and the damper is provided for the ink circulation tube. When printing is performed by ejecting ink from the head, in the circulation mechanism, the three-way valves connect the ink tank and the ink supply tube and connect the ink supply tube and the damper while blocking both ends of the ink circulation tube.

When the head is in a standby state, in the circulation mechanism, the three-way valves block the outlet of the ink tank and the inlet of the damper and connect the ink supply tube and the ink circulation tube, and the circulation pump circulates ink between the ink supply tube and the ink circulation tube. Like this, since the expensive three-way valves are provided, the circulation mechanism disclosed in PTL 1 has a tendency to drive up the costs of inkjet printers. Also, when ink is circulated, since the inlet of the damper is blocked, the circulation mechanism disclosed in PTL 1 cannot prevent deposition of the color materials of the ink in the damper.

The disclosure was made in view of the above-described circumstances, and the disclosure is to provide a damper and an ink circulation method capable of suppressing deposition of color materials of ink, and the disclosure is to provide an ink circulation method capable of reducing cost.

Solution to Problem

In order to solve the above-described problems, a damper according to the disclosure is a hydraulic head difference type damper for supplying ink supplied from an ink tank of an inkjet printer by a hydraulic head difference into ahead for ejecting the ink, including: a supply chamber configured to temporarily accommodate the ink; an ink chamber connected to the supply chamber through a connection passage and configured to supply ink to the head; and an on-off valve including a sealing body for blocking the connection passage, a flexible film attached so as to cover the ink chamber from the outside, an opening body configured to open the sealing body in cooperation with the flexible film, and an opening spring for biasing the opening body toward the outside of the ink chamber, and configured to move the sealing body toward one side by the opening body, thereby opening the connection passage, as the flexible film bends toward the inside of the ink chamber against a biasing force of the opening spring, if ink contained in the ink chamber decreases, and move the sealing body toward the other side, thereby blocking the connection passage, as the flexible film bends toward the outside of the ink chamber, if ink contained in the ink chamber increases, wherein a guide port for guiding the ink to a circulation tube for circulating the ink between the ink chamber and the ink tank side is formed in the ink chamber.

In this disclosure, since the guide port for guiding the ink into the circulation tube is formed in the ink chamber, when the ink is circulated between the head and the ink tank, the ink of the ink chamber is circulated between the ink chamber and the ink tank. Therefore, it is possible to suppress deposition of color materials of the ink in the ink chamber of the damper and the like.

Also, in order to circulate the ink contained in the ink chamber between the ink chamber and the ink tank, the suction power of the pump for circulating the ink is set to be significantly weak. Therefore, it is possible to circulate the ink in a state where a meniscus surface of a nozzle of the head is maintained, without providing three-way valves between the ink tank and the damper and at other positions. Therefore, it is possible to reduce cost.

Further, since the suction power of the pump for circulating the ink is set to be significantly weak, it is possible to achieve both of supply of the ink into the head and circulation of the ink. Therefore, it becomes possible to circulate the ink even during printing, and thus it is possible to surely suppress deposition of the color materials of the ink. Further, even if the suction power of the pump is set to be weak, since it is possible to circulate the ink, it is possible to suppress deposition of the color materials of the ink.

Also, in a state where the damper has been installed in the inkjet printer, in the above-described damper, the guide port can be disposed below an opening of the connection passage in the ink chamber.

In this disclosure, since the guide port is disposed below the opening of the connection passage, it is possible to surely circulate the ink contained in the ink chamber between the ink chamber and the ink tank.

Also, in the above-described damper, in a state where the damper has been installed in the inkjet printer, an ink inlet for guiding a supplied ink supplied from the ink tank into the supply chamber, and an ink circulation port for guiding ink guided from the guide port into the ink chamber to the circulation passage can be formed in an upper surface.

In this disclosure, since the ink inlet is formed in the upper surface, it is possible to supply the ink into the head by the hydraulic head difference. Further, since the ink inlet and the ink circulation port are formed in the upper surface, it is possible to easily connect the damper and the ink tank.

An ink circulation method of the disclosure is an ink circulation method which is usable in an inkjet printer having an ink supply passage for storing ink and supplying ink of an ink tank to a head for ejecting, and having the ink tank, a damper, and a head disposed in this order from the upstream side of the ink supply passage toward the downstream side, and circulates the ink between the head side and the ink tank side, wherein the damper includes a supply chamber configured to temporarily accommodate the ink, an ink chamber connected to the supply chamber through a connection passage and configured to supply ink to the head, and an on-off valve including a sealing body for blocking the connection passage, a flexible film attached so as to cover the ink chamber from the outside, an opening body configured to open the sealing body in cooperation with the flexible film, and an opening spring for biasing the opening body toward the outside of the ink chamber, and configured to move the sealing body toward one side by the opening body, thereby opening the connection passage, as the flexible film bends toward the inside of the ink chamber against a biasing force of the opening spring, if ink contained in the ink chamber decreases, and move the sealing body toward the other side, thereby blocking the connection passage, as the flexible film bends toward the outside of the ink chamber, if ink contained in the ink chamber increases, and in a state where a nozzle of the head and a flow passage of the damper for supplying ink to the head are connected, ink contained in the ink chamber is guided from a guide port formed in the ink chamber of the damper to one of a supply tube of the ink supply passage and the ink tank.

In this disclosure, since the ink is guided from the guide port formed in the ink chamber into one of the supply tube of the ink supply passage and the ink tank, it is possible to suppress deposition of the color materials of the ink by circulating the ink between the head and the ink tank.

Also, in order to circulate the ink contained in the ink chamber of the damper between the ink chamber and the ink tank, the suction power of a pump for circulating the ink is set to be significantly weak. Therefore, it is possible to circulate the ink in a state where a meniscus surface of a nozzle of the head is maintained, without providing three-way valves between the ink tank and the damper and at other positions. Therefore, it is possible to reduce the cost.

Further, since the suction power of the pump for circulating the ink is set to be significantly weak, it is possible to achieve both of supply of the ink into the head and circulation of the ink. Therefore, it becomes possible to circulate the ink even during printing, and thus it is possible to surely suppress deposition of the color materials of the ink. Further, even if the suction power of the pump is set to be weak, since it is possible to circulate the ink, it is possible to suppress deposition of the color materials of the ink.

Also, in the above-described ink circulation method, it is possible to directly connect the supply tube to the ink tank and an ink inlet of the damper, and directly connect a circulation tube of the ink supply passage to an ink circulation port of the damper and the supply tube, and drive a pump provided for the circulation tube so as to maintain a meniscus surface of ink formed at a leading end of the nozzle of the head.

In this disclosure, since the supply tube is directly connected to the ink tank and the ink inlet of the damper, and the circulation tube is directly connected to the ink circulation port of the damper and the supply tube, and the pump is driven so as to maintain the meniscus surface, it is possible to circulate the ink in a state where the meniscus surface is maintained, without providing three-way valves. Therefore, it is possible to reduce the cost, and it becomes possible to circulate the ink even during printing. Therefore, in this case, it is possible to surely suppress deposition of the color materials of the ink.

Also, in the above-described ink circulation method, in a state where the damper has been installed in the inkjet printer, the circulation tube can be disposed below the supply tube.

In this disclosure, since the circulation tube is disposed below the supply tube, when the ink is circulated by the pump, it is possible to make the internal pressure of the supply tube higher than the internal pressure of the circulation tube by a pressure corresponding to the hydraulic head difference. Therefore, it is possible to surely maintain the meniscus surface of the leading end of the head even during circulation, without providing three-way valves.

In order to solve the above-described problems, an ink circulation method of the disclosure is an ink circulation method which is usable in an inkjet printer having an ink supply passage for storing ink and supplying ink of an ink tank to a head for ejecting, and having the ink tank, a damper, and a head disposed in this order from the upstream side of the ink supply passage toward the downstream side, and circulates the ink between the head side and the ink tank side, wherein: the damper includes a supply chamber configured to temporarily accommodate the ink, an ink chamber connected to the supply chamber through a connection passage and configured to supply ink to the head, and an on-off valve including a sealing body for blocking the connection passage, a flexible film attached so as to cover the ink chamber from the outside, an opening body configured to open the sealing body in cooperation with the flexible film, and an opening spring for biasing the opening body toward the outside of the ink chamber, and configured to move the sealing body toward one side by the opening body, thereby opening the connection passage, as the flexible film bends toward the inside of the ink chamber against a biasing force of the opening spring, if ink contained in the ink chamber decreases, and move the sealing body toward the other side, thereby blocking the connection passage, as the flexible film bends toward the outside of the ink chamber, if ink contained in the ink chamber increases, and a circulation tube is connected to any one of an end portion of a supply tube of the ink supply passage positioned close to the damper on the upstream side from the damper, an end portion of the supply tube positioned close to the ink tank on the downstream side from the ink tank, and the ink tank, and when the sealing body blocks the connection passage, a pump is driven so as to circulate the ink between the supply tube and the circulation tube.

In this disclosure, since the pump is driven to circulate the ink when the sealing body blocks the connection passage, it is possible to circulate the ink in a state where the meniscus surface of the nozzle is maintained, without providing three-way valves on the upstream side of the damper. Also, in this disclosure, since it is possible to use the on-off valve of the damper, in place of a three-way valve, to circulate the ink, without providing three-way valves, it is possible to reduce the cost.

Also, in the above-described ink circulation method, the circulation tube can be connected to the ink tank.

In this disclosure, since the circulation tube is directly connected to the ink tank, it is possible to perform circulation of the ink including even the ink tank. Also, since this disclosure can set a long route for circulating the ink, it is possible to increase the proportion of a route for circulating the ink in the flow passage of the ink, and it is possible to improve the efficiency of circulation.

Also, in the above-described ink circulation method, the pump can be driven such that a pressure of the ink in such a direction that the sealing body blocks the connection passage acts on the supply chamber.

In this disclosure, since the pump is driven such that the connection passage is blocked by the sealing body, when the ink is circulated, the pump is driven such that a positive pressure is applied to the supply chamber of the damper. Therefore, according to this disclosure, when the ink is circulated, it is possible to block the connection passage by the sealing body.

In an ink circulation method, if the pump is driven such that the supply chamber of the damper has a negative pressure, the sealing body is pulled, whereby it becomes easier for the sealing body to open the connection passage. In other words, the ink circulation method may cause a situation in which when the pump is driven in order to circulate the ink, the sealing body opens the connection passage, whereby the pump exerts influence even on the ink contained in the head through the damper, thereby breaking the meniscus surface of the head. In order to prevent this situation, in the ink circulation method, it is required to provide a regulator in a route for circulating the ink, thereby performing severe management such as adjustment of the pressure of the ink, and install a sensor or the like for performing pressure adjustment, resulting in an increase in the cost of the entire device for circulating the ink.

However, this disclosure drives the pump such that the supply chamber of the damper has a positive pressure, thereby capable of making the sealing body act in a direction to block the connection passage. Therefore, for example, when it is desired to strongly drive the pump in order to circulate ink having a large amount of deposit, this disclosure can moderate the demand for management on the pressure of the ink when the pump is driven, as compared to a case of driving the pump such that the supply chamber of the damper has a negative pressure.

Also, since this disclosure drives the pump such that the sealing body of the damper blocks the connection passage, it is possible to isolate an area where the ink is circulated, from the head, and thus the ink contained in the head is not influenced. Therefore, this disclosure can circulate the ink without breaking the meniscus surface of the ink of the head.

Also, in the above-described ink circulation method, the supply tube can supply the ink from the ink tank into the head through the damper by a hydraulic head difference during printing of the inkjet printer, and the pump can be provided only for the circulation tube.

In this disclosure, during printing of the inkjet printer, the supply tube can supply the ink from the ink tank into the head by the hydraulic head difference. Therefore, it is not necessary to provide a pump for the supply tube, and thus this disclosure can reduce the cost. Also, since the pump is provided only for the circulation tube, even if the pump is broken and cannot send the ink, this disclosure can supply the ink from the ink tank into the head through the supply tube by the hydraulic head difference, and thus the inkjet printer can perform printing.

Also, in the above-described ink circulation method, when printing of the inkjet printer is stopped, the pump can be driven so as to circulate the ink. In this disclosure, since ink circulation is performed when printing is stopped, on the occasion of circulation of the ink, it is possible to stop a motion of the on-off valve provided in the ink chamber of the damper. In this disclosure, if printing of the inkjet printer is stopped in a state where the ink chamber of the damper is filled up with the ink, the sealing body blocks the connection passage. Therefore, in this disclosure, when the ink is circulated, it is possible to use the sealing body provided in the ink chamber of the damper, in place of a three-way valve, and it is possible to isolate an area where the ink is circulated and an area of the head. Therefore, even if the ink is circulated by the pump, the meniscus surface of the head is not broken, and it is possible to normally eject the ink even after circulation of the ink finishes.

Advantageous Effects of Disclosure

The damper and the ink circulation methods according to the disclosure achieve an effect that it is possible to suppress deposition of the color materials of the ink. Further, since the color materials and metal pigments are not deposited in the ink chamber, it is possible to make the damper efficiently function, without wasting the volume of the ink chamber.

Also, the damper and the ink circulation methods achieve an effect that it is possible to reduce the cost.

DESCRIPTION OF EMBODIMENTS

Hereinafter, embodiments according to the disclosure will be described in detail with reference to drawings. However, the disclosure is not limited by those embodiments. Also, components of the following embodiments include components which can be replaced by those skilled in the art and are easy, or substantially identical components.

[First Embodiment]

Figure 1:
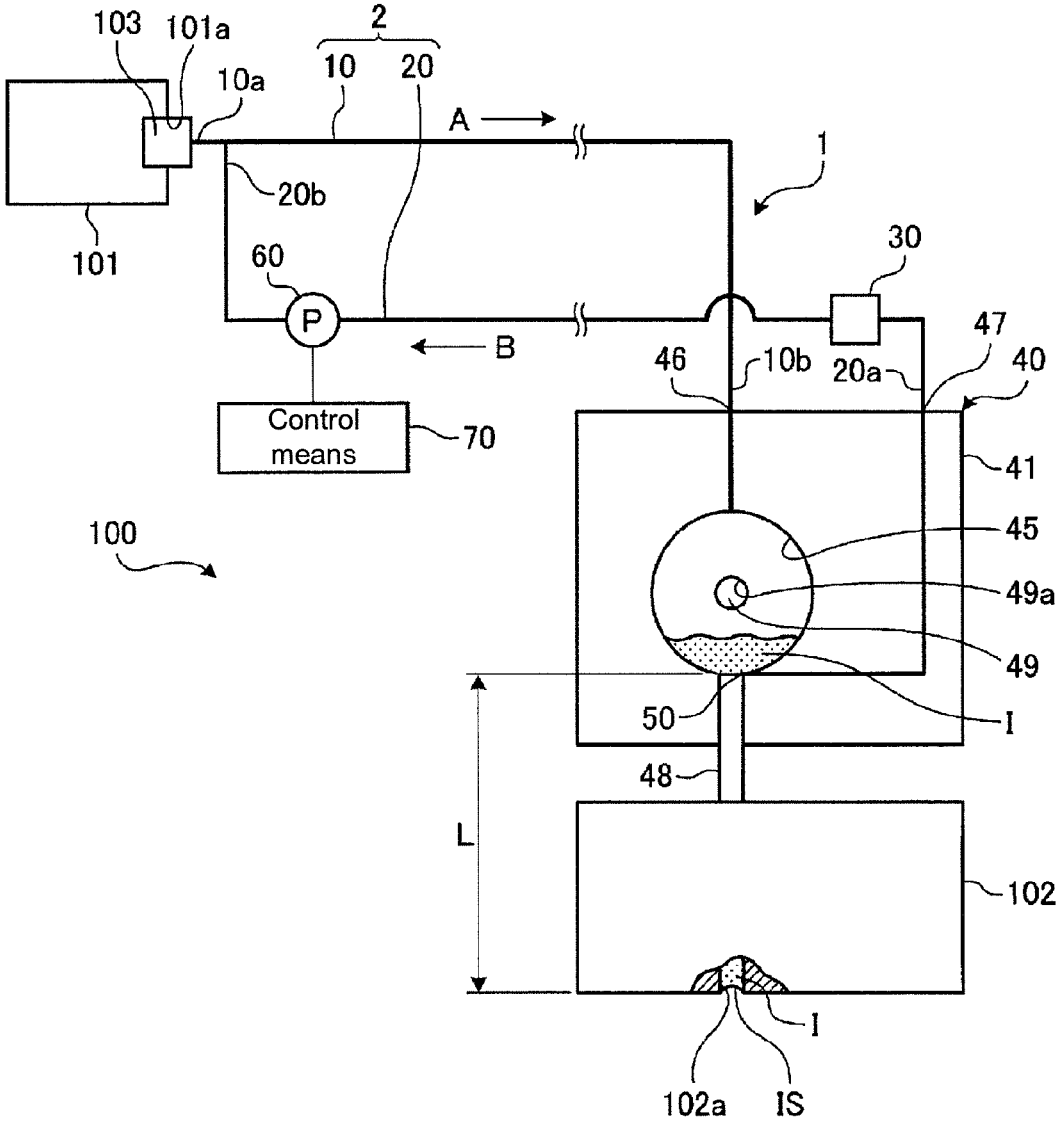
FIG. 1 is a view illustrating an example of a circulation mechanism having a damper according to a first embodiment.

Hereinafter, a circulation mechanism according to a first embodiment of the disclosure will be described in detail with reference to drawings. FIG. 1 is a view illustrating an example of a circulation mechanism having a damper according to the first embodiment.

An ink circulation mechanism 1 (hereinafter, referred to simply as the circulation mechanism) having a damper according to the first embodiment is applied to an inkjet printer 100. The inkjet printer 100 is a printer configured to perform printing on a print medium by reciprocating a head 102 having a plurality of nozzles 102*a* (FIG. 1 shows only one nozzle) for ejecting ink I supplied from ink tanks 101, in a main scan direction, and relatively moving the head 102 and the print medium in a sub scan direction perpendicular to the main scan direction, and ejecting the ink I from the nozzles 102*a* onto the print medium. In the ink tanks 101, ink I containing color materials likely to be deposited (such as white ink) and ink I containing color materials unlikely to be deposited (such as ink of cyan, magenta, yellow, and black) are stored.

The circulation mechanism 1 is a mechanism configured to circulate the ink I between the head 102 and the ink tanks 101, thereby particularly suppressing deposition of the color materials of the ink I wherein the color materials are likely to be deposited, such as white ink. In the disclosure, as the ink I likely to be deposited, metal pigment ink such as silver may be used. Also, the circulation mechanism 1 may circulate the ink I containing the color materials unlikely to be deposited. The circulation mechanism 1 circulates the ink I between the head 102 and the ink tanks 101, for example, in a standby state where reciprocating of the head 102 in the main scan direction and ejecting of the ink I from the nozzles 102*a* are stopped.

As shown in FIG. 1, the circulation mechanism 1 has ink supply passages 2, on-off valves 30, a damper 40, pumps 60, a control means 70, and so on. The ink supply passages 2 are passages for storing the ink I and supplying the ink I of the ink tanks 101 into the head 102 for ejecting. In the inkjet printer 100, the ink tanks 101, the damper 40, and the head 102 are disposed in this order from the upstream side of the ink supply passages 2 to the downstream side. The ink supply passages 2 are passages for sequentially supplying the ink from the ink tanks 101 into the damper 40 and the head 102 from the upstream side of an ink flow direction toward the downstream side, and are passages for circulating the ink I between the head 102 and the ink tanks 101, and have supply tubes 10 and circulation tubes 20. The supply tubes 10 and the circulation tubes 20 are made of a material having flexibility, and are formed in a pipe (tube) shape.

Ends 10*a* of the supply tubes 10 are directly connected to supply ports 101*a* of the ink tanks 101, and the other ends 10*b* are directly connected to ink inlets 46 of the damper 40. The supply tubes 10 supply the ink I stored in the ink tanks 101 to the damper 40 by a hydraulic head difference. Also, for the supply ports 101*a* of the ink tanks 101, on-off valves 103 are provided so as to be always open in a state where the ink tanks 101 are installed in the inkjet printer 100.

The circulation tubes 20 are tubes for circulating the ink I between the head and the ink tanks 101. Ends 20*a* of the circulation tubes 20 are directly connected to ink circulation ports 47 of the damper 40, and the other ends 20*b* are directly connected to the ends 10*a* of the supply tubes 10 connected to the ink tanks 101. The damper is installed in the inkjet printer 100 such that the circulation tubes 20 are installed below the supply tubes 10. In other words, in a state where the damper has been installed in the inkjet printer 100, the circulation tubes 20 are disposed below the supply tubes 10. The on-off valves 30 are provided at end portions of the circulation tubes 20 positioned close to the damper 40. The on-off valves 30 are valves for opening and closing the ink supply passages 2 which the circulation tubes 20 constitute.

Figure 2:
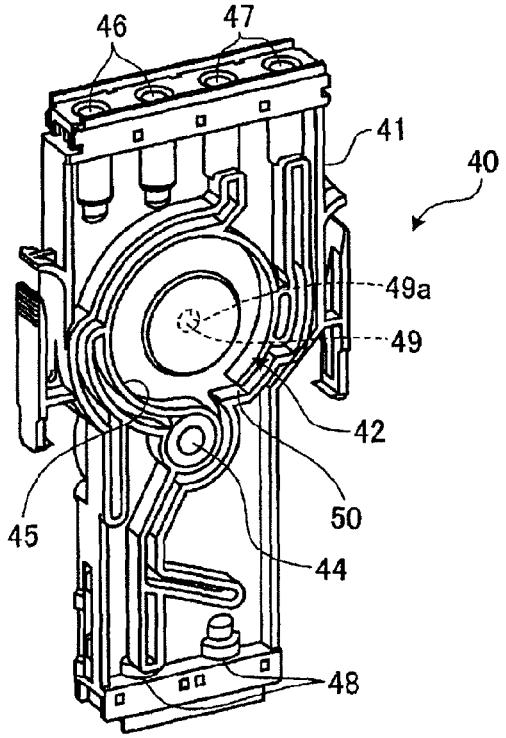
FIG. 2 is a perspective view of the damper according to the first embodiment.
Figure 3:
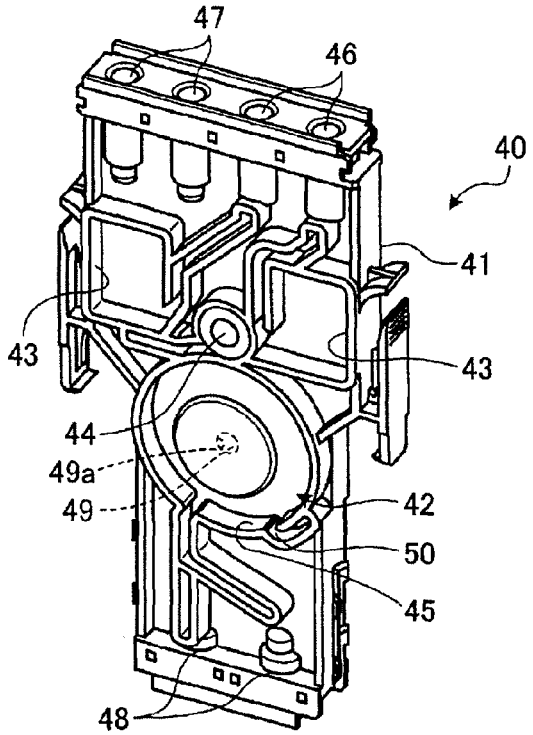
FIG. 3 is another perspective view of the damper according to the first embodiment.
Figure 4:
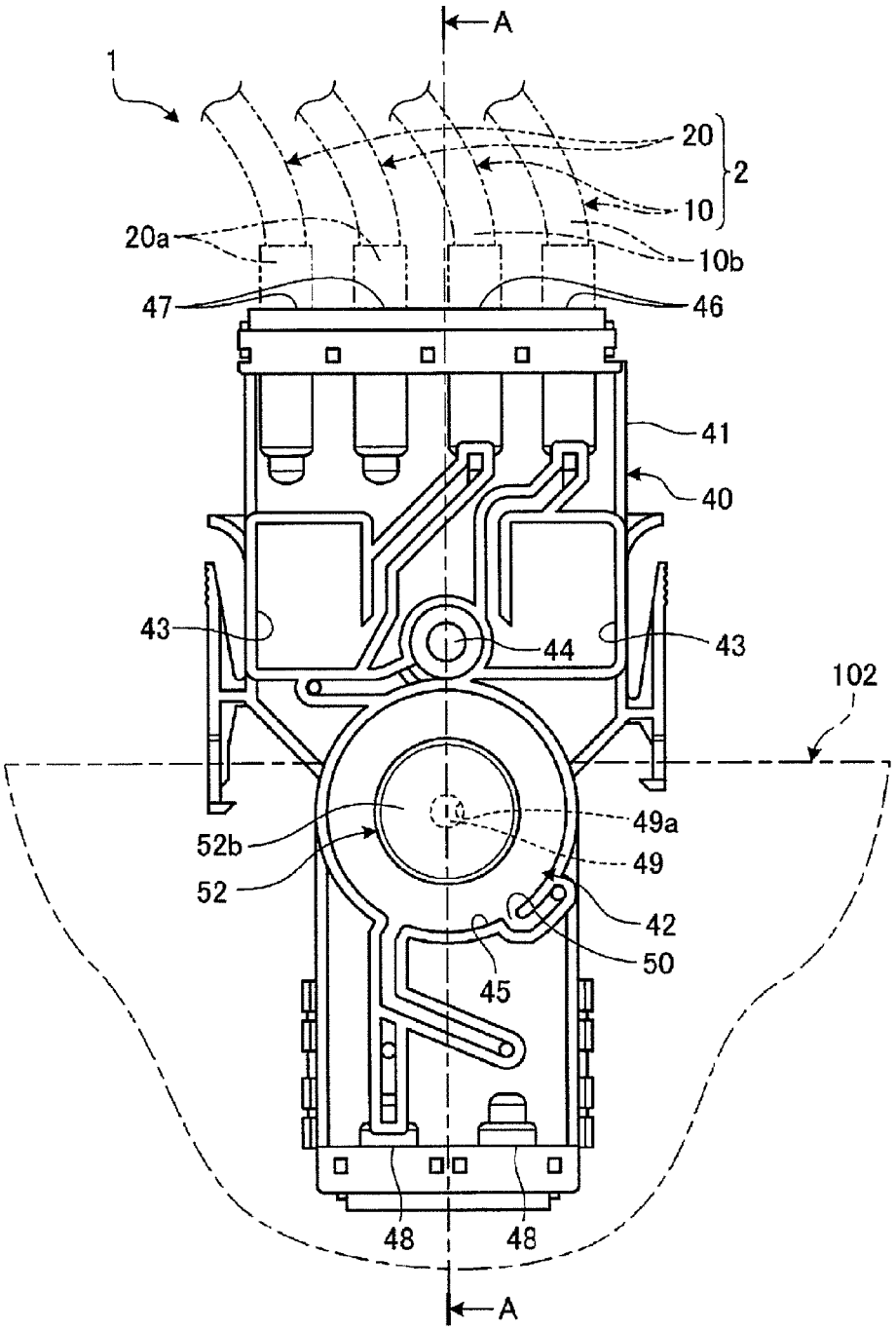
FIG. 4 is a side view of a state where the damper according to the first embodiment has been attached to a head.
Figure 5:
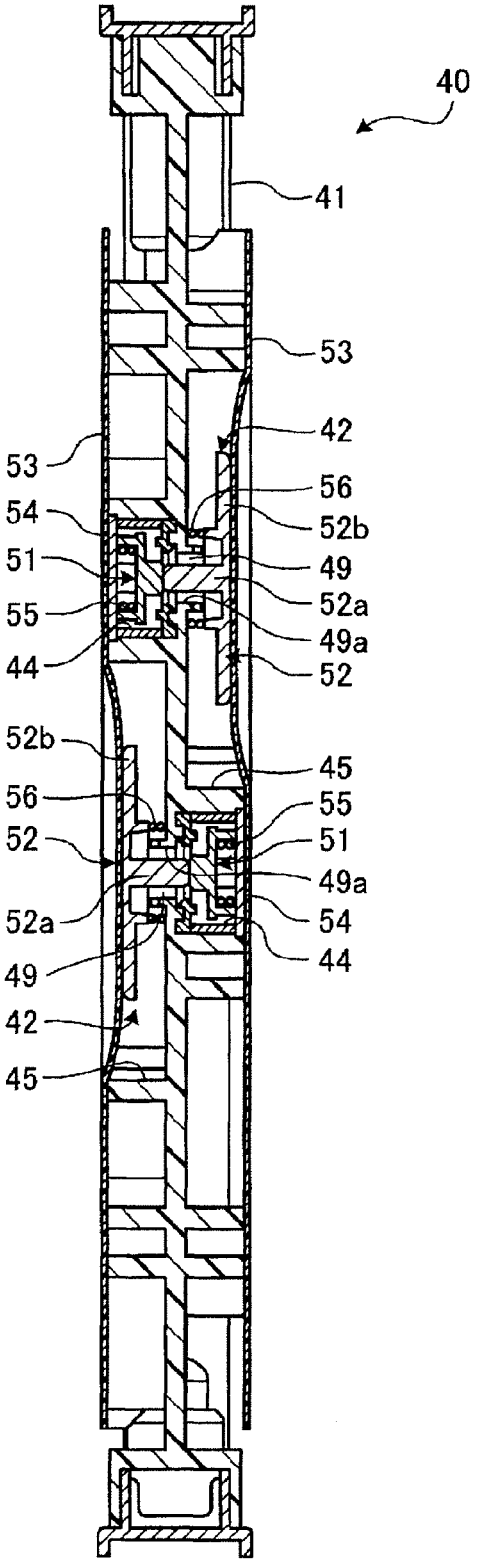
FIG. 5 is a cross-sectional view taken along a line A-A of FIG. 4.
Figure 6:
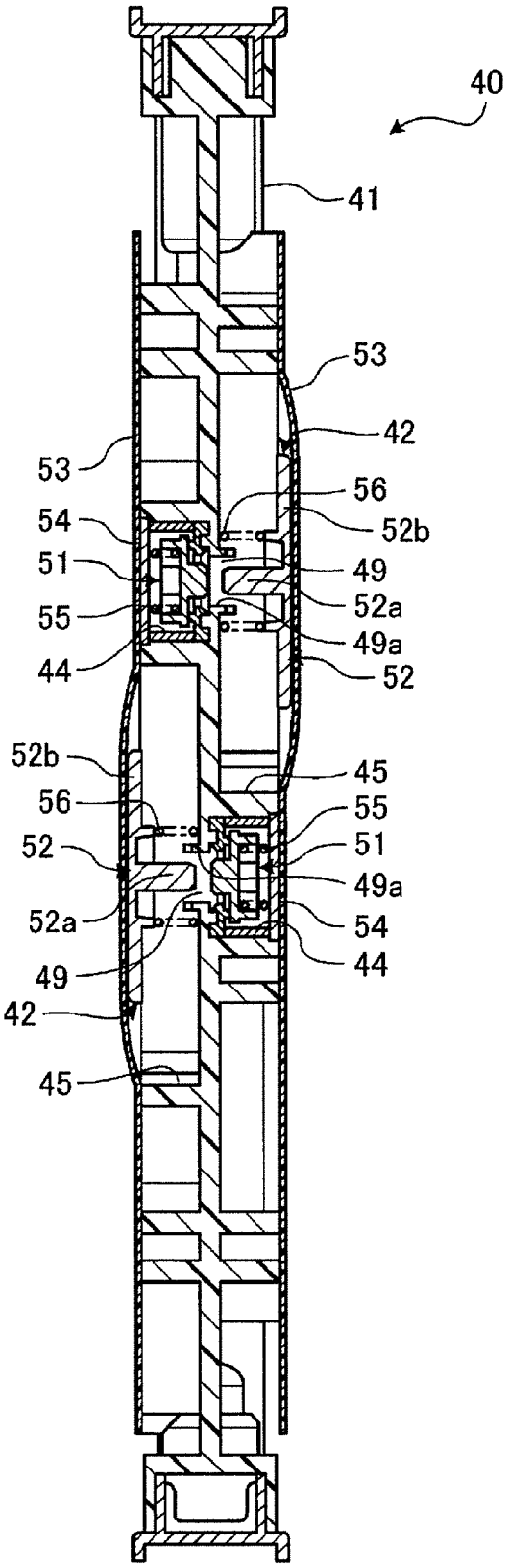
FIG. 6 is another cross-sectional view taken along the line A-A of FIG. 4.

Now, the damper according to the first embodiment will be described with reference to drawings. FIG. 2 is a perspective view of the damper according to the first embodiment. FIG. 3 is another perspective view of the damper according to the first embodiment. FIG. 4 is a side view of a state where the damper according to the first embodiment has been attached to the head. FIG. 5 is a cross-sectional view taken along a line A-A of FIG. 4. FIG. 6 is another cross-sectional view taken along the line A-A of FIG. 4.

The damper 40 is a hydraulic head difference type damper for supplying the ink I supplied from the ink tanks 101 of the inkjet printer 100 by the hydraulic head difference, into the head 102 for ejecting the ink I. The damper 40 is attached to the head 102 of the inkjet printer 100, and supplies the ink I supplied from the ink tanks 101 to the head 102. The damper 40 is a damper for supplying the ink I to the head 102 while adjusting the internal pressure of the head 102 to a predetermined, negative, and small pressure slightly lower than atmospheric pressure. In other words, the damper 40 is a damper configured to form meniscus surfaces IS (shown in FIG. 1) of the ink I in an upward convex curve shape at the leading ends of the nozzles 102*a* of the head 102.

As shown in FIG. 2 and FIG. 3, the damper 40 has a main damper body 41, filters provided in the main damper body 41 and not shown in the drawings, and on-off valves 42. The main damper body 41 is formed of a synthetic resin or the like in a substantially cuboid shape by mold injection, and is attached to the head 102 so as to be vertical on the head 102 as shown in FIG. 4. On both side surfaces of the main damper body 41 (shown in FIG. 3), filter chambers 43, supply chambers 44, and ink chambers 45 are formed. The filter chambers 43, the supply chambers 44, and the ink chambers 45 are spaces recessed from both side surfaces of the main damper body 41, and in the first embodiment, two filter chambers 43, two the supply chambers 44, and two ink chambers 45 are provided.

Also, in a state where the main damper body 41 has been attached to the head 102, that is, in a state where it has been installed in the inkjet printer 100, two ink inlets 46 and two ink circulation ports 47 are formed in the upper surface of the main damper body 41. As shown in FIG. 4, the other ends 10*b* of the supply tubes 10 are connected to the ink inlets 46, and the ends 20*a* of the circulation tubes 20 are connected to the ink circulation ports 47. The ink inlets 46 are inlets for receiving the ink I from the ink tanks 101 by the hydraulic head difference and guiding the received ink I to the supply chambers 44. The ink circulation ports 47 guide the ink I contained in the ink chambers 45 to the circulation tubes 20 of the ink supply passages 2. In the state where the main damper body 41 has been attached tp the head 102, that is, in the state where it has been installed in the inkjet printer 100, two head inlets 48 for supplying the ink I into the head 102 are formed in the lower surface of the main damper body 41. In the first embodiment, the ink inlets 46, the filter chambers 43, the supply chambers 44, the ink chambers 45, the ink circulation ports 47, and the head inlets 48 correspond to one another on a one-to-one basis.

The filter chambers 43 receive the ink I through the corresponding ink inlets 46. The filter chambers 43 contain the filters (not shown) for filtering the ink I, thereby removing foreign materials from the ink I. The supply chambers 44 receive the ink I filtered by the filters contained in the corresponding filter chambers 43. The supply chambers 44 temporarily accommodate the received ink I.

The ink chambers 45 are provided on the rear sides of the corresponding supply chambers 44, and are connected to the supply chambers 44 through connection passages 49, and supply the ink I supplied from the supply chambers 44 into the head 102. Also, in the ink chambers 45, guide ports 50 for guiding the ink contained in the ink chambers 45 to the circulation tubes 20 are formed. The guide ports 50 guide the ink I contained in the ink chambers 45 to the ink circulation ports 47, and the ink circulation ports 47 guides the ink I supplied from the ink chambers 45 through the guide ports 50, to the circulation tubes 20. In a state where the damper 40 has been installed in the inkjet printer 100, the guide ports 50 are disposed below openings 49*a* of the connection passages 49 provided in the ink chambers 45.

The on-off valves 42 are valves configured to open the connection passages 49 if the ink I contained in the ink chambers 45 decreases and block the connection passages 49 if the ink I contained in the ink chambers 45 increases. As shown in FIG. 5 and FIG. 6, the on-off valves 42 have sealing bodies 51, opening bodies 52, and flexible films 53.

The sealing bodies 51 are bodies for blocking the connection passages 49, and are formed in a disc shape, and are stored in the supply chambers 44. The sealing bodies 51 are formed in a disc shape larger than the openings 49*a* of the connection passages 49. The sealing bodies 51 are biased in a direction to block the connection passages 49 by sealing springs 55 provided between the sealing bodies and sealing caps 54 for blocking openings of the supply chambers 44 formed in both side surfaces of the main damper body 41. The sealing bodies 51 separate from the openings 49*a* of the connection passages 49, thereby opening the connection passages 49, and come into close contact with the openings 49*a* of the connection passages 49, thereby blocking the connection passages 49.

The opening bodies 52 are bodies for making the sealing bodies 51 open the connection passages 49 as the flexible films 53 bend. Each opening body 52 has a columnar opening part 52*a* and a disc-shaped pressure receiving part 52*b* integrated with each other. The external diameter of the pressure receiving part 52*b* is larger than the external diameter of the opening part 52*a*, and the opening part 52*a* is provided so as to be vertical on the center of the pressure receiving part 52*b*. The external diameter of the opening part 52*a* may be smaller than the internal diameters of the connection passages 49. The opening bodies 52 are stored in the ink chambers 45 such that the pressure receiving parts 52*b* are positioned on both surface sides of the main damper body 41 and the opening parts 52*a* face the connection passages 49. The opening bodies 52 are biased toward directions away from the connection passages 49, that is, toward the outer sides of the ink chambers 45 by opening springs 56 provided between the pressure receiving parts 52*b* and the bottom surfaces of the ink chambers 45. If the opening bodies 52 separate from the connection passages 49 by the biasing forces of the opening springs 56, they separate from the sealing bodies 51, and maintain the sealing bodies 51 in a state where the sealing bodies block the connection passages 49. The opening bodies 52 approach the connection passages 49 such that the opening parts 52*a* press the sealing bodies 51 against the biasing forces of the sealing springs 55, thereby opening the connection passages 49.

The flexible films 53 are made of a synthetic resin or the like having flexibility, and are formed in a sheet shape. The flexible films 53 are welded on both side surfaces of the main damper body 41, the pressure receiving parts 52*b* of the opening bodies 52, the sealing caps 54, and the like, thereby being attached to both side surfaces of the main damper body 41 so as to cover the ink chambers 45 from the outsides. The flexible films 53 seal the filter chambers 43, the supply chambers 44, the ink chambers 45, and so on. Also, the pressure receiving parts 52*b* are welded on the flexible films 53, whereby the flexible films support the opening bodies 52 such that the opening bodies are movable in directions toward the connection passages 49 and directions away from the connection passages. Like this, the damper 40 is a predetermined mechanical damper in which the on-off valves 42 are composed of the sealing bodies 51, the opening bodies 52, the flexible films 53, and so on.

The pumps 60 are provided only for the circulation tubes 20, and send the ink I contained in the ink chambers 45 of the damper 40 toward the ink tanks 101 through the circulation tubes 20, and toward the damper 40 through the supply tubes 10, thereby circulating the ink I between the head 102 and the ink tanks 101. As the pumps 60, well-known tubing pumps and diaphragm pumps can be used.

The control means 70 is a means for controlling the individual units of the inkjet printer 100 including the pumps 60 of the circulation mechanism 1 and the head 102. The control means 70 is composed of hardware such as an arithmetic device and a memory, and a program configured to implement predetermined functions of them.

Then, if a print command is input to the control means 70, the control means 70 performs controls such that the ink I is ejected from the nozzles 102*a* of the head 102 while the head 102 reciprocates in the main scan direction by the control means 70 and the head 102 and a print medium relatively move in the sub scan direction, whereby the above-described inkjet printer 100 performs printing on the print medium in a predetermined pattern. During printing, the pumps 60 are stopped. Like this, during printing, the ink I is ejected from the nozzles 102*a* of the head 102, and the ink I according to an amount of ejection is supplied from the damper 40 to the head 102. Therefore, it is possible to stably eject the ink I from the nozzles 102*a* of the head 102 without a shortage of ink I. For example, as shown in FIG. 6, in a state where the connection passages 49 are blocked by the sealing bodies 51, if the opening bodies 52 are separated from the connection passages 49 by the biasing forces of the opening springs 56, the flexible films 53 bend outward from both side surfaces of the main damper body 41, and the on-off valves 42 apply negative pressures to the insides of the ink chambers 45. In the state where the connection passages 49 are blocked by the sealing bodies 51, if the ink I is ejected from the nozzles 102*a* of the head 102, as the ink I is ejected, the internal pressures of the nozzles 102*a* of the head 102 gradually decrease and the internal pressures of the ink chambers 45 connected to the nozzles 102*a* of the head 102 gradually decrease.

If the ink I contained in the ink chambers 45 decreases, whereby the total forces of the internal pressures of the ink chambers 45 and the biasing forces of the opening springs 56 become lower than atmospheric pressure acting on the outer sides of the flexible films 53, the flexible films 53 bend toward the insides of the ink chambers 45 against the biasing forces of the opening springs 56. Further, as the flexible films 53 bend, the opening bodies 52 are brought close to the connection passages 49 against the biasing forces of the opening springs 56, and the sealing bodies 51 are pressed in directions to open the connection passages 49 against the biasing forces of the sealing springs 55 by the opening parts 52*a* of the opening bodies 52, whereby the sealing bodies 51 are moved toward sides away from the openings 49*a* of the connection passages 49 as shown in FIG. 5, whereby the connection passages 49 are opened, whereby the ink I is supplied from the supply chambers 44 into the ink chambers 45. In this way, supply of the ink I into the nozzles 102*a* of the head 102 and supply of the ink I into the ink chambers 45 are performed at the same time.

As the ink I is supplied from the supply chambers 44 into the ink chambers 45, the internal pressures of the ink chambers 45 gradually increases, whereby the ink I contained in the ink chambers 45 increase. Then, the total forces of the internal pressures of the ink chambers 45 and the biasing forces of the opening springs 56 become higher than atmospheric pressure acting on the outer sides of the flexible films 53. Then, the flexible films 53 bend toward the outsides of the ink chambers 45 by the internal pressures of the ink chambers 45 and the biasing forces of the opening springs 56, whereby the flexible films 53 move so as to increase the volumes of the ink chambers 45. Also, as shown in FIG. 6, as the flexible films 53 bend toward the outsides of the ink chambers 45, the opening parts 52*a* of the opening bodies 52 are separated from the sealing bodies 51. Therefore, the sealing springs 55 move the sealing bodies 51 toward the other sides, such that the sealing bodies approach the openings 49*a* of the connection passages 49, thereby blocking the connection passages 49, whereby supply of the ink I from the supply chambers 44 into the ink chambers 45 is stopped. Like this, during printing, with reference to the ink tanks 101 positioned on the upstream side, the inkjet printer 100 sequentially supplies the ink I from the ink tanks 101 into the supply tubes 10, the damper 40, and the head 102, toward the downstream side.

Next, if printing of the print command input to the control means 70 is completed, the above-described inkjet printer 100 transitions to a standby state. In the standby state, the control means 70 stops movement of the head 102 in the main scan direction, and stops movements of the head 102 and the print medium in the sub scan direction, and stops ejection of the ink I from the nozzles 102*a* of the head 102. Further, when the inkjet printer 100 is in the standby state (printing is stopped), the control means 70 of the inkjet printer 100 performs an ink circulation method using the circulation mechanism 1. The ink circulation method is a method of circulating the ink I between the ink tanks 101 and the head 102 into which the ink I is supplied from the ink tanks 101 by the hydraulic head difference. In other words, the ink circulation method is a method of circulating the ink I between the head 102 and the ink tanks 101.

In the ink circulation method, in a state where the nozzles 102*a* of the head 102 are connected to the head inlets 48 of the damper 40 serving as flow passages for supplying the ink I into the head 102, the control means 70 operates the pumps 60. Like this, in the ink circulation method, when printing of the inkjet printer 100 is stopped, the pumps 60 are driven to circulate the ink I. In the ink circulation method, if the pumps 60 are operated, the ink I contained in the ink chambers 45 is sucked .from the guide ports 50 through the circulation tubes 20, the ink circulation ports 47, and the like, whereby the ink I contained in the ink chambers 45 is guided from the guide ports 50 into the circulation tubes 20. The ink I is supplied into the supply tubes 10 through the circulation tubes 20, and is supplied into the damper 40. Then, the connection passages 49 of the damper 40 are opened and blocked by the sealing bodies 51 and the opening bodies 52, whereby the ink I supplied into the damper 40 is stored in the ink chambers 45. In this way, the ink circulation method circulates the ink between the ink tanks 101 and the head 102. At this time, the control means 70 drives the pumps 60 at a predetermined speed or the like. Also, the predetermined speed means a speed at which the pressure of the ink I becomes such a pressure that it is possible to maintain the meniscus surfaces IS of the ink I in the nozzles 102*a* of the head 102. For example, in a case where the meniscus strength is A (kPa: a gauge pressure), the control means 70 drives the pumps 60 such that the pressure of the ink I in the nozzles 102*a* of the head 102 becomes a pressure higher than A (kPa: the gauge pressure). In other words, the control means 70 drives the pumps 60 such that the meniscus surfaces IS formed at the leading ends of the nozzles 102*a* of the head 102 are maintained.

Also, a hydraulic head pressure can be obtained by the product of the acceleration of gravity, the hydraulic head difference, and the specific gravity of the ink. For example, if it is assumed that the hydraulic head difference between the ink chambers 45 and the leading ends of the nozzles 102*a* of the head 102 is L, and the specific gravity of the ink is p, the hydraulic head pressure between the ink chambers 45 and the leading ends of the nozzles 102*a* becomes 9.8 ρL (kPa), and in a case where L is Bm, the hydraulic head pressure between the ink chambers 45 and the leading ends of the nozzles 102*a* becomes 9.8 ρB (kPa). In the case where the meniscus strength is A (kPa: the gauge pressure), the control means 70 drives the pumps 60 at the predetermined speed such that the internal pressures of the ink chambers 45 of the damper 40 become a negative pressure C (kPa: a gauge pressure) higher than A, and the pressures of the leading ends of the nozzles 102*a* of the head 102 become the sum of C and 9.8 ρB (kPa: the gauge pressure) . Also, in the disclosure, pressure sensors and the like may be provided in the ink chambers 45, and the control means 70 may drive the pumps 60 by so-called feedback control such that it is possible to maintain the meniscus surfaces IS.

According to the above-described damper 40 of the first embodiment, since the guide ports 50 for guiding the ink I into the circulation tubes 20 are formed in the ink chambers 45, when the ink I is circulated between the head 102 and the ink tanks 101, the ink I of the ink chambers 45 is circulated between the ink chambers and the ink tanks 101. Therefore, it is possible to suppress deposition of the color materials of the ink in the ink chambers 45 of the damper 40 and the like. Further, since the color materials and metal pigments are not deposited in the ink chambers 45, the damper 40 can make the damper 40 efficiently function, without wasting the volumes of the ink chambers 45.

Also, according to the damper 40, in order to circulate the ink I contained in the ink chambers 45 between the ink chambers and the ink tanks 101, the suction power of the pumps 60 for circulating the ink I is set to be significantly weak. Therefore, it is possible to circulate the ink in a state where the meniscus surfaces IS of the nozzles 102*a* of the head 102 are maintained, without providing three-way valves between the ink tanks 101 and the damper 40 and at other positions. Therefore, it is possible to reduce the cost. Further, since the ink I contained in the ink chambers 45 is guided into the circulation tubes 20 by the pumps 60 having the weak suction power, even if the damper 40 is a damper in which the on-off valves 42 are mechanical valves, it can circulate the ink I in a state where the meniscus surfaces IS of the nozzles 102*a* of the head 102 are maintained. Like this, the disclosure is particularly suitable for the mechanical damper 40.

Further, since the suction power of the pumps 60 for circulating the ink I is set to be significantly weak, it is possible to achieve both of supply of the ink I into the head 102 and circulation of the ink I. Therefore, it becomes possible to circulate ink I even during printing, and thus it is possible to surely suppress deposition of the color materials of the ink I. Further, even if the suction power of the pumps 60 is set to be weak, since it is possible to circulate the ink I, it is possible to suppress deposition of the color materials of the ink I.

Also, since the guide ports 50 are disposed below the openings 49*a* of the connection passages 49, the damper 40 can surely circulate the ink I contained in the ink chambers 45 between the ink chambers and the ink tanks 101.

Also, since the ink inlets 46 are formed in the upper surface of the main damper body 41, the damper 40 can supply the ink I into the head 102 by the hydraulic head difference. Further, since the ink inlets 46 and the ink circulation ports 47 are formed at the upper surface of the main damper body 41, it is possible to easily connect the damper 40 and the ink tanks 101.

Also, since an ink circulation method according to the above-described first embodiment guides the ink I from the guide ports 50 formed in the ink chambers 45 into the circulation tubes 20, it is possible to suppress deposition of the color materials of the ink I in the ink chambers 45 of the damper 40 and the like.

Also, since the ink circulation method directly connects the supply tubes 10 to the ink tanks 101 and the ink inlets 46 of the damper 40, and directly connects the circulation tubes 20 to the ink circulation ports 47 of the damper 40 and the supply tubes 10, and drives the pumps 60 such that the meniscus surfaces IS are maintained, it is possible to circulate the ink I in a state where the meniscus surfaces IS of the nozzles 102*a* of the head 102 are maintained, without providing three-way valves. Therefore, it is possible to reduce the cost.

Also, since the suction power of the pumps 60 for circulating the ink I is set to be significantly weak, it is possible to achieve both of supply of the ink I into the head 102 and circulation of the ink I, and in this case, it is possible to surely suppress deposition of the color materials of the ink I.

Also, since the circulation tubes 20 are disposed below the supply tubes 10, when the ink circulation method circulates the ink I by the pumps 60, it is possible to make the internal pressures of the supply tubes 10 higher than the internal pressures of the circulation tubes 20 by a pressure corresponding to the hydraulic head difference. Therefore, it is possible to surely maintain the meniscus surfaces IS of the leading ends of the nozzles 102*a* of the head 102 even during circulation, without providing three-way valves.

[Modification of First Embodiment]

Figure 7:
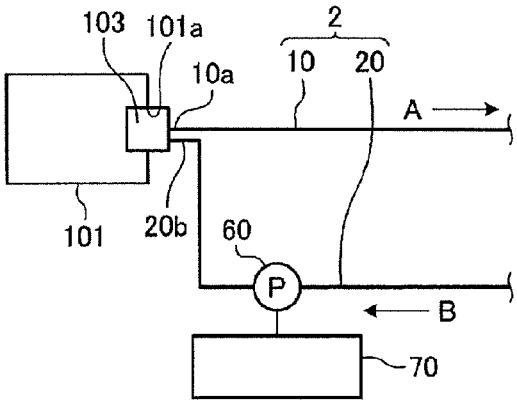
FIG. 7 is a view illustrating an example of a main part of a circulation mechanism having a damper according to a modification of the first embodiment.

Hereinafter, a circulation mechanism according to a modification of the first embodiment of the disclosure will be described in detail on the basis of a drawing. FIG. 7 is a view illustrating an example of amain part of a circulation mechanism having a damper according to the modification of the first embodiment. Also, in FIG. 7, parts identical to those of the first embodiment are denoted by the same reference symbols, and a description thereof is omitted.

Figure 8:
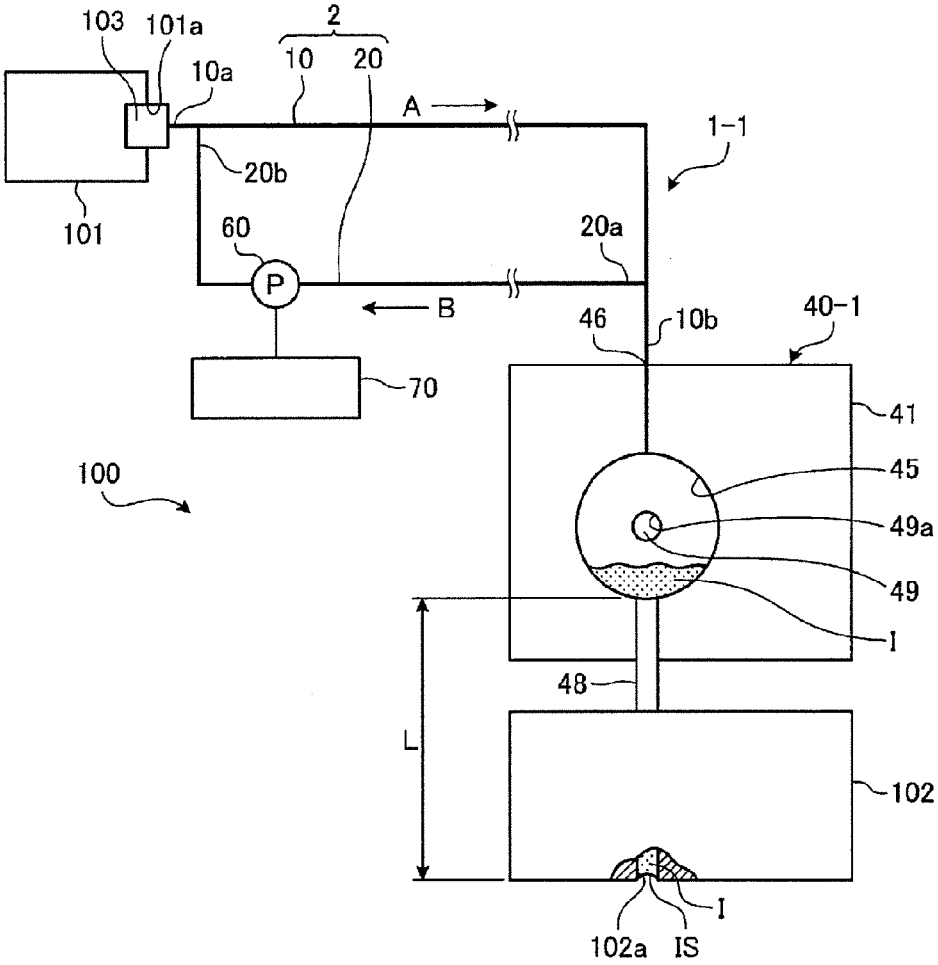
FIG. 8 is a view illustrating an example of a circulation mechanism having a damper according to a second embodiment.

In a circulation mechanism 1-1 according to the modification of the first embodiment, in a state where the other ends 20*b* of the circulation tubes 20 are directly connected to the supply ports 101*a* of the ink tanks 101, whereby the nozzles 102*a* of the head 102 and the flow passages of the damper 40 for supplying the ink into the head 102 are connected as shown in FIG. 8, the ink contained in the ink chambers 45 is guided from the guide ports 50 formed in the ink chambers 45 of the damper 40 into the ink tanks 101.

An ink circulation method according to the above-described modification of the first embodiment guides the ink from the guide ports 50 formed in the ink chambers 45 into the ink tanks 101, and thus can suppress deposition of the color materials of the ink I in the ink chambers 45 of the damper 40 and the like.

[Second Embodiment]

Now, a circulation mechanism 1-1 having a damper 40-1 according to a second embodiment will be described. FIG. 8 is a view illustrating an example of a circulation mechanism having a damper according to the second embodiment.

The ink circulation mechanism 1-1 (hereinafter, referred to simply as the circulation mechanism) having the damper according to the second embodiment is applied to the inkjet printer 100. The inkjet printer 100 is a printer configured to perform printing on a print medium by reciprocating a head 102 having a plurality of nozzles 102*a* (FIG. 8 shows only one nozzle) for ejecting ink I supplied from ink tanks 101, in a main scan direction, and relatively moving the head 102 and the print medium in a sub scan direction perpendicular to the main scan direction, and ejecting the ink I from the nozzles 102*a* onto the print medium. In the ink tanks 101, ink I containing color materials likely to be deposited (such as white ink) and ink I containing color materials unlikely to be deposited (such as ink of cyan, magenta, yellow, and black) are stored.

The circulation mechanism 1-1 is a mechanism configured to circulate the ink I between the head 102 and the ink tanks 101, thereby particularly suppressing deposition of the color materials of the ink I wherein the color materials are likely to be deposited, such as white ink. In the disclosure, as the ink I likely to be deposited, metal pigment ink such as silver may be used. Also, the circulation mechanism 1-1 may circulate the ink I containing the color materials unlikely to be deposited. The circulation mechanism 1-1 circulates the ink I between the head 102 and the ink tanks 101, for example, in a standby state where reciprocating of the head 102 in the main scan direction and ejecting of the ink I from the nozzles 102*a* are stopped.

As shown in FIG. 8, the circulation mechanism 1-1 has ink supply passages 2, the damper 40-1, pumps 60, a control means 70, and so on. The ink supply passages 2 are passages for storing the ink I and supplying the ink I of the ink tanks 101 into the head 102 for ejecting. In the inkjet printer 100, the ink tanks 101, the damper 40-1, and the head 102 are disposed in this order from the upstream side of the ink supply passages 2 to the downstream side. The ink supply passages 2 are passages for sequentially supplying the ink from the ink tanks 101 into the damper 40-1 and the head 102 from the upstream side of an ink flow direction toward the downstream side, and are passages for circulating the ink I between the head 102 and the ink tanks 101, and have supply tubes 10 (corresponding to ink supply passages) and circulation tubes 20 (corresponding to ink circulation passages). The supply tubes 10 and the circulation tubes 20 are made of a material having flexibility, and are formed in a pipe (tube) shape.

Ends 10*a* of the supply tubes 10 are directly connected to supply ports 101*a* of the ink tanks 101, and the other ends 10*b* are directly connected to ink inlets 46 of the damper 40-1. During printing of the inkjet printer 100, the supply tubes 10 supply the ink I stored in the ink tanks 101 to the damper 40-1 by a hydraulic head difference. Also, for the supply ports 101*a* of the ink tanks 101, on-off valves 103 are provided so as to be always open in a state where the ink tanks 101 are installed in the inkjet printer 100.

Figure 11:
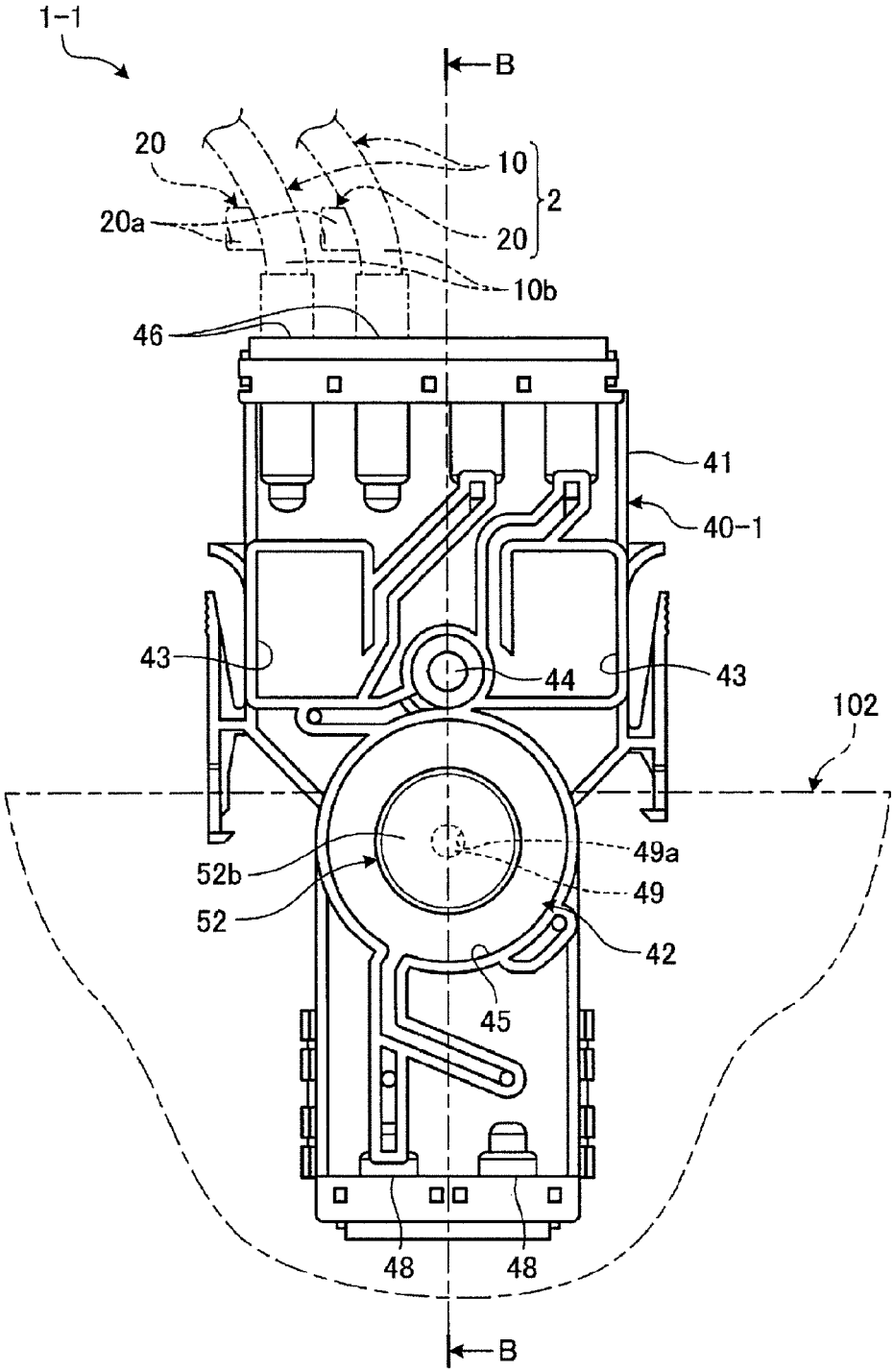
FIG. 11 is a side view of a state where the damper according to the second embodiment has been attached to a head.

The circulation tubes 20 are tubes for circulating the ink I between the head and the ink tanks 101. As shown in FIG. 8 and FIG. 11, ends 20*a* of the circulation tubes 20 are directly connected to the other ends 10*b* of the supply tubes 10 (corresponding to end portions positioned close to the damper 40-1 on the upstream side from the damper 40-1). The other ends 20*b* of the circulation tubes 20 are directly connected to the ends 10*a* of the supply tubes 10 (corresponding to end portions positioned close to the ink tanks 101 on the downstream side from the ink tanks 101) connected to the ink tanks 101. The damper is installed in the inkjet printer 100 such that the circulation tubes 20 are installed below the supply tubes 10. In other words, in a state where the damper has been installed in the inkjet printer 100, the circulation tubes 20 are disposed below the supply tubes 10.

Figure 9:
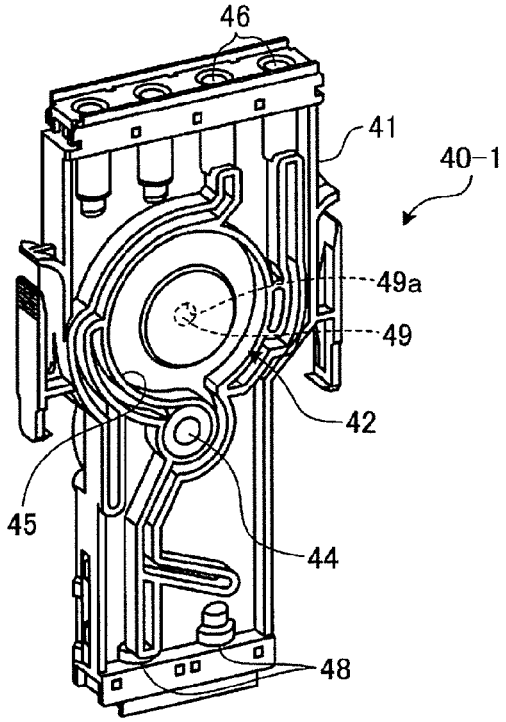
FIG. 9 is a perspective view of the damper according to the second embodiment.
Figure 10:
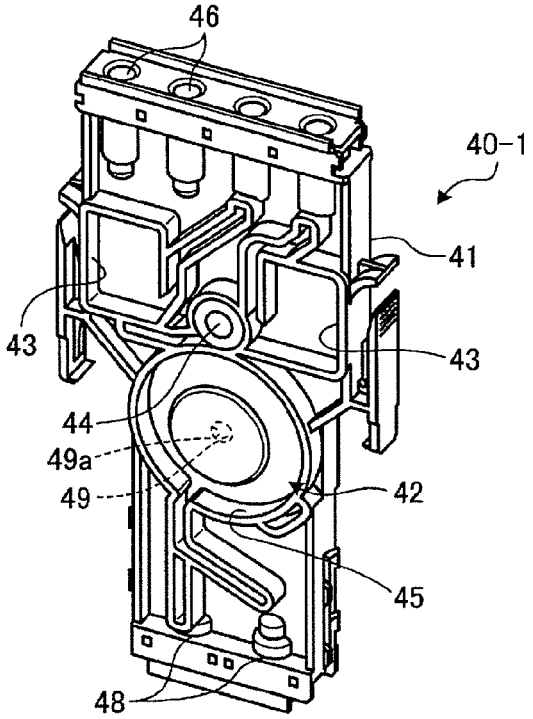
FIG. 10 is another perspective view of the damper according to the second embodiment.
Figure 12:
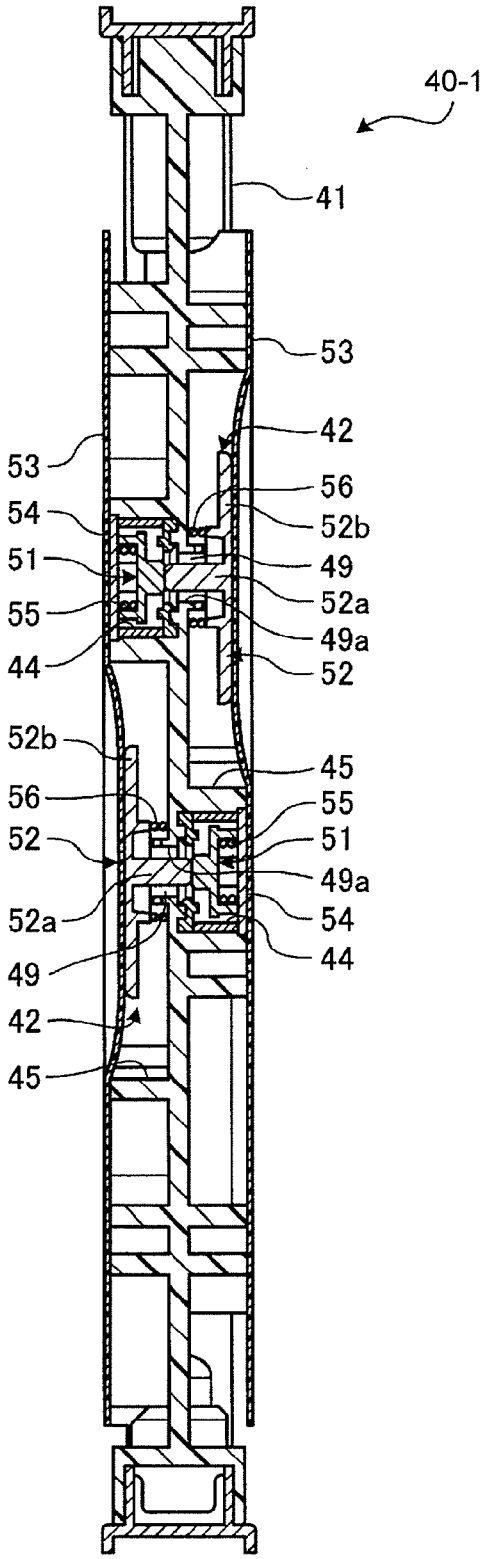
FIG. 12 is a cross-sectional view taken along a line B-B of FIG. 11.
Figure 13:
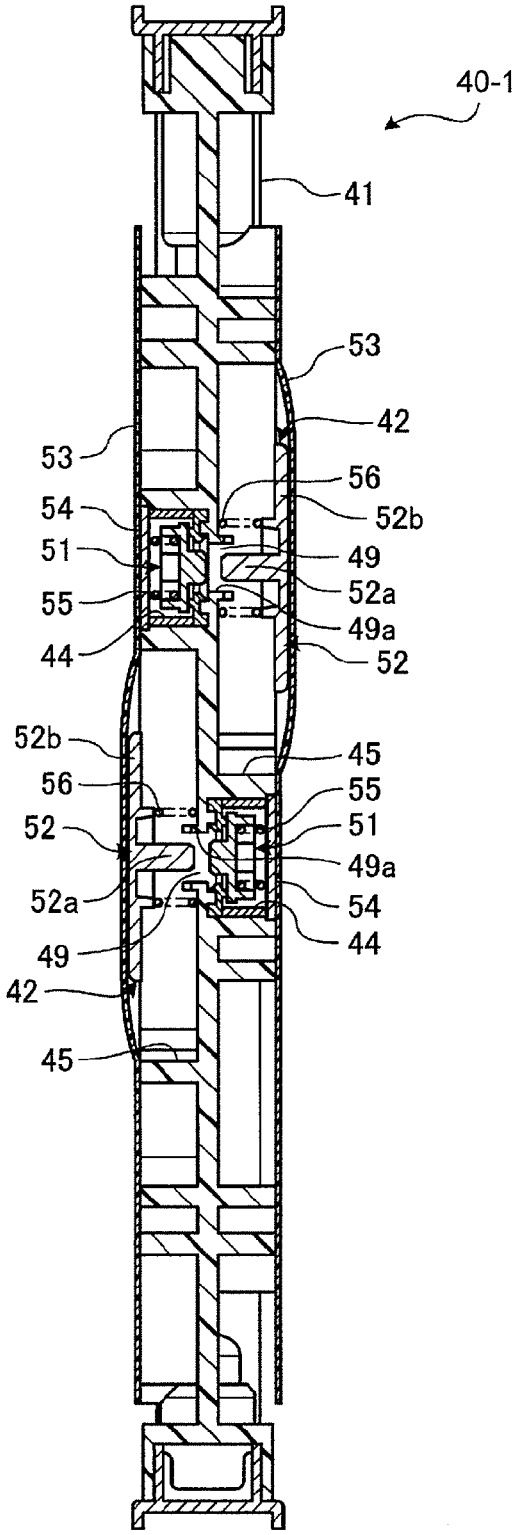
FIG. 13 is another cross-sectional view taken along the line B-B of FIG. 11.

Now, the damper according to the second embodiment will be described with reference to drawings. FIG. 9 is a perspective view of the damper according to the second embodiment. FIG. 10 is another perspective view of the damper according to the second embodiment. FIG. 11 is a side view of a state where the damper according to the second embodiment has been attached to the head. FIG. 12 is a cross-sectional view taken along a line B-B of FIG. 11. FIG. 13 is another cross-sectional view taken along the line B-B of FIG. 11.

The damper 40-1 is a hydraulic head difference type damper for supplying the ink I supplied from the ink tanks 101 by the hydraulic head difference, into the head 102 for ejecting the ink I during printing of the inkjet printer 100. The damper 40-1 is attached to the head 102 of the inkjet printer 100, and supplies the ink I supplied from the ink tanks 101 to the head 102. The damper 40-1 is a damper for supplying the ink Ito the head 102 while adjusting the internal pressure of the head 102 to a predetermined, negative, and small pressure slightly lower than atmospheric pressure. In other words, the damper 40-1 is a damper configured to form meniscus surfaces IS (shown in FIG. 8) of the ink I in an upward convex curve shape at the leading ends of the nozzles 102*a* of the head 102.

As shown in FIG. 9 and FIG. 10, the damper 40-1 has a main damper body 41, filters provided in the main damper body 41 and not shown in the drawings, and on-off valves 42. The main damper body 41 is folined of a synthetic resin or the like in a substantially cuboid shape by mold injection, and is attached to the head 102 so as to be vertical on the head 102 as shown in FIG. 11. On both side surfaces of the main damper body 41, filter chambers 43 (shown in FIG. 10), supply chambers 44, and ink chambers 45 are formed. The filter chambers 43, the supply chambers 44, and the ink chambers 45 are spaces recessed from both side surfaces of the main damper body 41, and in the second embodiment, two filter chambers 43, two the supply chambers 44, and two ink chambers 45 are provided.

Also, in a state where the main damper body 41 has been attached to the head 102, that is, it has been installed in the inkjet printer 100, two ink inlets 46 are formed in the upper surface of the main damper body 41. As shown in FIG. 11, the other ends 10*b* of the supply tubes 10 are connected to the ink inlets 46, and the end 20*a* of the circulation tubes 20 are connected to the other end 10*b* of the supply tubes 10. The ink inlets 46 are inlets for receiving the ink I from the ink tanks 101 by the hydraulic head difference and guiding the received ink I to the supply chambers 44. In the state where the main damper body 41 has been attached to the head 102, that is, in the state where it has been installed in the inkjet printer 100, two head inlets 48 for supplying the ink I into the head 102 are formed in the lower surface of the main damper body 41. In the second embodiment, the ink inlets 46, the filter chambers 43, the supply chambers 44, the ink chambers 45, and the head inlets 48 correspond to one another on a one-to-one basis.

The filter chambers 43 receive the ink I through the corresponding ink inlets 46. The filter chambers 43 contain the filters (not shown) for filtering the ink I, thereby removing foreign materials from the ink I. The supply chambers 44 receive the ink I filtered by the filters contained in the corresponding filter chambers 43. The supply chambers 44 temporarily accommodate the received ink I.

The ink chambers 45 are provided on the rear sides of the corresponding supply chambers 44, and are connected to the supply chambers 44 through connection passages 49, and supply the ink I supplied from the supply chambers 44 into the head 102. Also, as shown in FIG. 9, FIG. 10, and FIG. 11, the damper 40-1 has no guide ports 50 formed in the ink chambers 45.

The on-off valves 42 are valves configured to open the connection passages 49 if the ink I contained in the ink chambers 45 decreases and block the connection passages 49 if the ink I contained in the ink chambers 45 increases. As shown in FIG. 12 and FIG. 13, the on-off valves 42 have sealing bodies 51, opening bodies 52, and flexible films 53.

The sealing bodies 51 are bodies for blocking the connection passages 49, and are formed in a disc shape, and are stored in the supply chambers 44. The sealing bodies 51 are formed in a disc shape larger than the openings 49*a* of the connection passages 49. The sealing bodies 51 are biased in a direction to block the connection passages 49 by sealing springs 55 provided between the sealing bodies and sealing caps 54 for blocking openings of the supply chambers 44 formed in both side surfaces of the main damper body 41. The sealing bodies 51 separate from the openings 49*a* of the connection passages 49, thereby opening the connection passages 49, and come into close contact with the openings 49*a* of the connection passages 49, thereby blocking the connection passages 49.

The opening bodies 52 are bodies for making the sealing bodies 51 open the connection passages 49 as the flexible films 53 bend. Each opening body 52 has a columnar opening part 52*a* and a disc-shaped pressure receiving part 52*b* integrated with each other. The external diameter of the pressure receiving part 52*b* is larger than the external diameter of the opening part 52*a*, and the opening part 52*a* is provided so as to be vertical on the center of the pressure receiving part 52*b*. The external diameter of the opening part 52*a* may be smaller than the internal diameters of the connection passages 49. The opening bodies 52 are stored in the ink chambers 45 such that the pressure receiving parts 52*b* are positioned on both surface sides of the main damper body 41 and the opening parts 52*a* face the connection passages 49. The opening bodies 52 are biased toward directions away from the connection passages 49, that is, toward the outer sides of the ink chambers 45 by opening springs 56 provided between the pressure receiving parts 52*b* and the bottom surfaces of the ink chambers 45. If the opening bodies 52 separate from the connection passages 49 by the biasing forces of the opening springs 56, they separate from the sealing bodies 51, and maintain the sealing bodies 51 in a state where the sealing bodies block the connection passages 49. The opening bodies 52 approach the connection passages 49 such that the opening parts 52*a* press the sealing bodies 51 against the biasing forces of the sealing springs 55, thereby opening the connection passages 49.

The flexible films 53 are made of a synthetic resin or the like having flexibility, and are formed in a sheet shape. The flexible films 53 are welded on both side surfaces of the main damper body 41, the pressure receiving parts 52*b* of the opening bodies 52, the sealing caps 54, and the like, thereby being attached to both side surfaces of the main damper body 41 so as to cover the ink chambers 45 from the outsides. The flexible films 53 seal the filter chambers 43, the supply chambers 44, the ink chambers 45, and so on. Also, the pressure receiving parts 52*b* are welded on the flexible films 53, whereby the flexible films support the opening bodies 52 such that the opening bodies are movable in directions toward the connection passages 49 and directions away from the connection passages. Like this, the damper 40-1 is a predetermined mechanical damper in which the on-off valves 42 are composed of the sealing bodies 51, the opening bodies 52, the flexible films 53, and so on.

The pumps 60 are provided only for the circulation tubes 20, and send the ink I contained in the ink chambers 45 of the damper 40-1 toward the ink tanks 101 through the circulation tubes 20, and toward the damper 40-1 through the supply tubes 10, thereby circulating the ink I between the head 102 and the ink tanks 101. As the pumps 60, well-known tubing pumps and diaphragm pumps can be used.

The control means 70 is a means for controlling the individual units of the inkjet printer 100 including the pumps 60 of the circulation mechanism 1 and the head 102. The control means 70 is composed of hardware such as an arithmetic device and a memory, and a program configured to implement predetermined functions of them.

Then, if a print command is input to the control means 70, the control means 70 performs controls such that the ink I is ejected from the nozzles 102*a* of the head 102 while the head 102 reciprocates in the main scan direction by the control means 70 and the head 102 and a print medium relatively move in the sub scan direction, whereby the above-described inkjet printer 100 performs printing on the print medium in a predetermined pattern. During printing, the pumps 60 are stopped. Like this, during printing, the ink I is ejected from the nozzles 102*a* of the head 102, and the ink I according to an amount of ejection is supplied from the damper 40-1 to the head 102. Therefore, it is possible to stably eject the ink I from the nozzles 102*a* of the head 102 without a shortage of the ink I. For example, as shown in FIG. 13, in a state where the connection passages 49 are blocked by the sealing bodies 51, if the opening bodies 52 are separated from the connection passages 49 by the biasing forces of the opening springs 56, the flexible films 53 bend outward from both side surfaces of the main damper body 41, and the on-off valves 42 apply negative pressures to the insides of the ink chambers 45. In the state where the connection passages 49 are blocked by the sealing bodies 51, if the ink I is ejected from the nozzles 102*a* of the head 102, as the ink I is ejected, the internal pressures of the nozzles 102*a* of the head 102 gradually decrease and the internal pressures of the ink chambers 45 connected to the nozzles 102*a* of the head 102 gradually decrease.

If the ink I stored in the ink chambers 45 decreases, whereby the total forces of the internal pressures of the ink chambers 45 and the biasing forces of the opening springs 56 become lower than atmospheric pressure acting on the outer sides of the flexible films 53, the flexible films 53 bend toward the insides of the ink chambers 45 against the biasing forces of the opening springs 56. Further, as the flexible films 53 bend, the opening bodies 52 are brought close to the connection passages 49 against the biasing forces of the opening springs 56, and the sealing bodies 51 are pressed in directions to open the connection passages 49 against the biasing forces of the sealing springs 55 by the opening parts 52*a* of the opening bodies 52, whereby the sealing bodies 51 are moved toward sides away from the openings 49*a* of the connection passages 49 as shown in FIG. 12, whereby the connection passages 49 are opened, whereby the ink I is supplied from the supply chambers 44 into the ink chambers 45. In this way, supply of the ink I into the nozzles 102*a* of the head 102 and supply of the ink I into the ink chambers 45 are performed at the same time.

As the ink I is supplied from the supply chambers 44 into the ink chambers 45, the internal pressures of the ink chambers 45 gradually increase, whereby the ink I contained in the ink chambers 45 increases. Then, the total forces of the internal pressures of the ink chambers 45 and the biasing forces of the opening springs 56 become higher than atmospheric pressure acting on the outer sides of the flexible films 53. Then, the flexible films 53 bend toward the outsides of the ink chambers 45 by the internal pressures of the ink chambers 45 and the biasing forces of the opening springs 56, whereby the flexible films 53 move so as to increase the volumes of the ink chambers 45. Also, as shown in FIG. 13, as the flexible films 53 bend toward the outsides of the ink chambers 45, the opening parts 52*a* of the opening bodies 52 are separated from the sealing bodies 51. Therefore, the sealing springs 55 move the sealing bodies 51 toward the other sides, such that the sealing bodies approach the openings 49*a* of the connection passages 49, thereby blocking the connection passages 49, whereby supply of the ink I from the supply chambers 44 into the ink chambers 45 is stopped. Like this, during printing, with reference to the ink tanks 101 positioned on the upstream side, the inkjet printer 100 sequentially supplies the ink I from the ink tanks 101 into the supply tubes 10, the damper 40-1, and the head 102, toward the downstream side.

Next, if printing of the print command input to the control means 70 is completed, the above-described inkjet printer 100 transitions to a standby state. In the standby state, the control means 70 stops movement of the head 102 in the main scan direction, and stops movements of the head 102 and the print medium in the sub scan direction, and stops ejection of the ink I from the nozzles 102*a* of the head 102. Further, when the inkjet printer 100 is in the standby state (printing is stopped) , that is, when the sealing bodies 51 block the connection passages 49, the control means 70 of the inkjet printer 100 performs an ink circulation method using the circulation mechanism 1. The ink circulation method is a method of circulating the ink I between the ink tanks 101 and the head 102 into which the ink I is supplied from the ink tanks 101 by the hydraulic head difference. In other words, the ink circulation method is a method of circulating the ink I between the head 102 and the ink tanks 101.

In the ink circulation method, when the sealing bodies 51 block the connection passages 49, the control means 70 operates the pumps 60, thereby circulating the ink I between the supply tubes 10 and the circulation tubes 20. Like this, in the ink circulation method, when printing of the inkjet printer 100 is stopped, the pumps 60 are operated to circulate the ink I. In the ink circulation method, if the pumps 60 are driven, the ink I contained in the other ends 10*b* of the supply tubes 10 is sucked through the circulation tubes 20 and the like, whereby the ink I contained in the supply tubes 10 is guided into the circulation tubes 20. The ink I is supplied into the ends 10*a* of the supply tubes 10 through the circulation tubes 20. In this way, the ink circulation method circulates the ink between the ink tanks 101 and the head 102. At this time, the control means 70 drives the pumps 60 at a predetermined speed or the like. Also, the predetermined speed means a speed at which the pressure of the ink I becomes such a pressure that it is possible to maintain the meniscus surfaces IS of the ink I in the nozzles 102*a* of the head 102. For example, in a case where the meniscus strength is A (kPa: a gauge pressure), the control means 70 drives the pumps 60 such that the pressure of the ink I in the nozzles 102*a* of the head 102 becomes a pressure higher than A (kPa: the gauge pressure). In other words, the control means 70 drives the pumps 60 such that the meniscus surfaces IS formed at the leading ends of the nozzles 102*a* of the head 102 are maintained.

Also, a hydraulic head pressure can be obtained by the product of the acceleration of gravity, the hydraulic head difference, and the specific gravity of the ink. For example, if it is assumed that the hydraulic head difference between the ink chambers 45 and the leading ends of the nozzles 102*a* of the head 102 is L, and the specific gravity of the ink is ρ, the hydraulic head pressure between the ink chambers 45 and the leading ends of the nozzles 102*a* becomes 9.8ρL (kPa), and in a case where L is Bm, the hydraulic head pressure between the ink chambers 45 and the leading ends of the nozzles 102*a* becomes 9.8ρB (kPa). In the case where the meniscus strength is A (kPa: the gauge pressure), the control means 70 drives the pumps 60 at the predetermined speed such that the internal pressures of the ink chambers 45 of the damper 40-1 become a negative pressure C (kPa: a gauge pressure) higher than A, and the pressures of the leading ends of the nozzles 102*a* of the head 102 become the sum of C and 9.8ρB (kPa: the gauge pressure). Also, in the disclosure, pressure sensors and the like may be provided in the ink chambers 45, and the control means 70 may drive the pumps 60 by so-called feedback control such that it is possible to maintain the meniscus surfaces IS.

Further, in the second embodiment, when the ink I is circulated between the ink tanks 101 and the head 102 to which the ink I is supplied from the ink tanks 101 by the hydraulic head difference, the control means 70 drives the pumps 60 such that the pressure of the ink I in such directions that the sealing bodies 51 block the connection passages 49 acts on the supply chambers 44 of the damper 40-1. For example, in the second embodiment, in a state where the ink chambers 45 of the damper 40-1 have been filled up with the ink I, the control means 70 stops printing.

According to the ink circulation method of the above-described second embodiment, since the pumps 60 are driven to circulate the ink when the sealing bodies 51 block the connection passages 49, it is possible to circulate the ink I in a state where the meniscus surfaces IS of the nozzles 102*a* are maintained, without providing three-way valves on the upstream side of the damper 40-1. Also, since the damper 40-1 uses the on-off valves 42 in place of three-way valves, thereby capable of circulating the ink I, without providing three-way valves, it is possible to reduce the cost. Further, since it is possible to achieve both of supply of the ink I into the head 102 and circulation of the ink I, it is possible to surely suppress deposition of the color materials of the ink I.

In the ink circulation method, in order to circulate the ink I between the ink chambers and the ink tanks 101, the suction power of the pumps 60 for circulating the ink I is set to be significantly weak. Therefore, it is possible to circulate the ink I in a state where the meniscus surfaces IS of the nozzles 102*a* of the head 102 are maintained, without providing three-way valves between the ink tanks 101 and the damper 40-1 and at other positions. Therefore, it is possible to reduce the cost.

Also, in the second embodiment, since the ink circulation method performs circulation of the ink I when printing is stopped, on the occasion of circulation of the ink I, it is possible to stop motions of the on-off valves 42 provided in the ink chambers 45 of the damper 40-1. If printing of the inkjet printer 100 is stopped in a state where the ink chambers 45 have been filled up with the ink I, the damper 40-1 becomes a state where the sealing bodies 51 block the connection passages 49. Therefore, in the second embodiment, when the ink I is circulated, it is possible to use the sealing bodies 51 provided in the ink chambers 45 of the damper 40-1, in place of three-way valves, and it is possible to isolate an area where the ink I is circulated and an area of the head 102. Therefore, even if the ink I is circulated by the pumps 60, the meniscus surfaces IS of the head 102 are not broken, and it is possible to normally eject the ink even after circulation of the ink I finishes.

Like this, in the second embodiment, since the ink circulation method can use the sealing bodies 51 of the insides of the ink chambers 45 in place of three-way valves, and guides the ink I into the ink supply passages 2 by the pumps 60 having the weak suction power, even if the damper is a damper in which the on-off valves 42 are mechanical valves, it can circulate the ink I in a state where the meniscus surfaces IS of the nozzles 102*a* of the head 102 are maintained. Like this, the disclosure is particularly suitable for the mechanical damper 40-1.

Further, since the ink circulation method sets the suction power of the pumps 60 for circulating the ink I to be significantly weak, it is possible to achieve both of supply of the ink I into the head 102 and circulation of the ink I. Therefore, it becomes possible to circulate the ink I even during printing, and thus the ink circulation method can surely suppress deposition of the color materials of the ink I. Further, even if the suction power of the pumps 60 is set to be weak, since it is possible to circulate the ink I, it is possible to suppress deposition of the color materials of the ink I.

Also, since the ink inlets 46 are formed in the upper surface of the main damper body 41, the ink circulation method can supply the ink I into the head 102 by the hydraulic head difference. Also, since the ink inlets 46 are formed in the upper surface of the main damper body 41, it is possible to easily connect the damper 40-1 and the ink tanks 101.

Also, according to the ink circulation method of the second embodiment, since the circulation tubes 20 are disposed below the supply tubes 10, when the ink I is circulated by the pumps 60, it is possible to make the internal pressures of the supply tubes 10 higher than the internal pressures of the circulation tubes 20 by a pressure corresponding to the hydraulic head difference. Therefore, the ink circulation method can surely maintain the meniscus surfaces IS of the leading ends of the nozzles 102*a* of the head 102 even during circulation, without providing three-way valves.

According to the ink circulation method of the second embodiment, since the pumps 60 are driven such that the pressure of the ink I in directions to block the connection passages 49 by the sealing bodies 51 acts on the supply chambers 44, when the ink I is circulated, the pumps 60 are driven such that a positive pressure is applied to the supply chambers 44 of the damper 40-1. Therefore, according to the ink circulation method, when the ink I is circulated, it is possible to block the connection passages 49 by the sealing bodies 51.

In an ink circulation method, if the pumps 60 are driven such that the supply chambers 44 of the damper 40-1 have a negative pressure, the sealing bodies 51 are pulled, whereby it becomes easier for the sealing bodies 51 to open the connection passages 49. In other words, the ink circulation method may cause a situation in which when the pumps 60 are driven in order to circulate the ink I, the sealing bodies 51 open the connection passages 49, whereby the pumps exert influence even on the ink I contained in the head 102 through the damper 40-1, thereby breaking the meniscus surfaces IS of the head 102. In order to prevent this situation, in the ink circulation method, it is required to provide a regulator in a route for circulating the ink I, thereby performing severe management such as adjustment of the pressure of the ink I, and install a sensor or the like for performing pressure adjustment, resulting in an increase in the cost of the entire device for circulating the ink I.

However, the ink circulation method of the second embodiment drives the pumps 60 such that the supply chambers 44 of the damper 40-1 have a positive pressure, thereby capable of making the sealing bodies 51 act in directions to block the connection passages 49. Therefore, for example, when it is desired to strongly drive the pumps 60 in order to circulate the ink I having a large amount of deposit, the ink circulation method of the second embodiment can moderate the demand for management on the pressure of the ink I when the pumps 60 are driven, as compared to a case of driving the pumps 60 such that the supply chambers 44 of the damper 40-1 have a negative pressure.

Also, since the ink circulation method of the second embodiment drives the pumps 60 such that the sealing bodies 51 of the damper 40-1 block the connection passages 49, it is possible to isolate the area where the ink I is circulated, from the head 102, and thus the ink I contained in the head 102 is not influenced. Therefore, the ink circulation method of the second embodiment can circulate the ink I without breaking the meniscus surfaces IS of the ink I of the head 102.

Also, in the ink circulation method of the second embodiment, during printing of the inkjet printer 100, the supply tubes 10 can supply the ink I from the ink tanks 101 into the head 102 by the hydraulic head difference. Therefore, it is not necessary to provide pumps 60 for the supply tubes 10, and thus the ink circulation method of the second embodiment can reduce the cost. Also, since the pumps 60 are provided only for the circulation tubes 20, even if the pumps 60 are broken and cannot send the ink I, the ink circulation method of the second embodiment can supply the ink from the ink tanks 101 into the head 102 through the supply tubes 10 by the hydraulic head difference, and thus the inkjet printer 100 can perform printing.

[First Modification of Second Embodiment]

Figure 14:
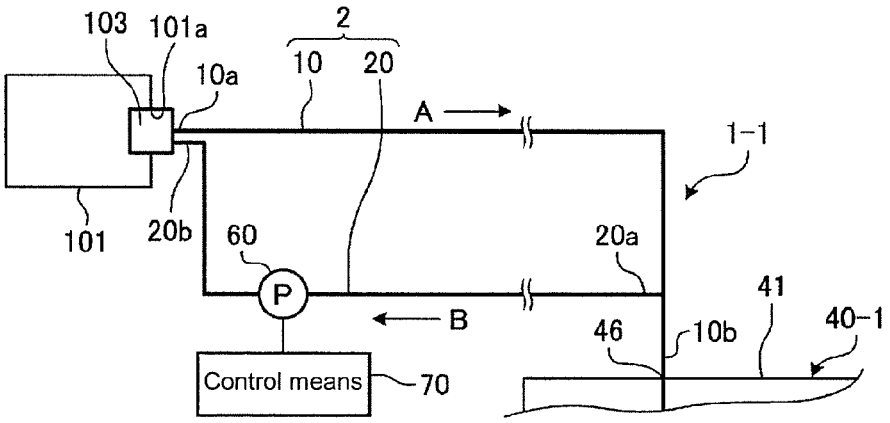
FIG. 14 is a view illustrating an example of a main part of a circulation mechanism having a damper according to a first modification of the second embodiment.

Hereinafter, a circulation mechanism according to a first modification of the second embodiment of the disclosure will be described in detail with reference to a drawing. FIG. 14 is a view illustrating an example of a main part of a circulation mechanism having a damper according to the first modification of the second embodiment. Also, in FIG. 14, parts identical to those of the second embodiment are denoted by the same reference symbols, and a description thereof is omitted.

In a circulation mechanism 1-1 according to the first modification of the second embodiment, as shown in FIG. 14, the other ends 20*b* of the circulation tubes 20 are directly connected to the supply ports 101*a* of the ink tanks 101.

An ink circulation method according to the above-described first modification of the second embodiment guides the ink I from the other ends 10*b* of the supply tubes 10 into the ink tanks 101, and performs circulation of the ink I when printing is stopped. Therefore, it is possible to use the sealing bodies 51 provided in the ink chambers 45 of the damper 40-1, in place of three-way valves, to circulate the ink I, and it is possible to reduce the cost. Further, since the other ends 20*b* of the circulation tubes 20 are directly connected to the supply ports 101*a* of the ink tanks 101, the ink circulation method according to the first modification of the second embodiment can perform circulation of the ink I including not only the ink supply passages 2 but also the ink tanks 101. Also, since the ink circulation method according to the first modification of the second embodiment can set a long route for circulating the ink I, it is possible to increase the proportion of the route for circulating the ink I in the flow passage of the ink I, and it is possible to improve the efficiency of circulation.

[Second Modification of Second Embodiment]

Figure 15:
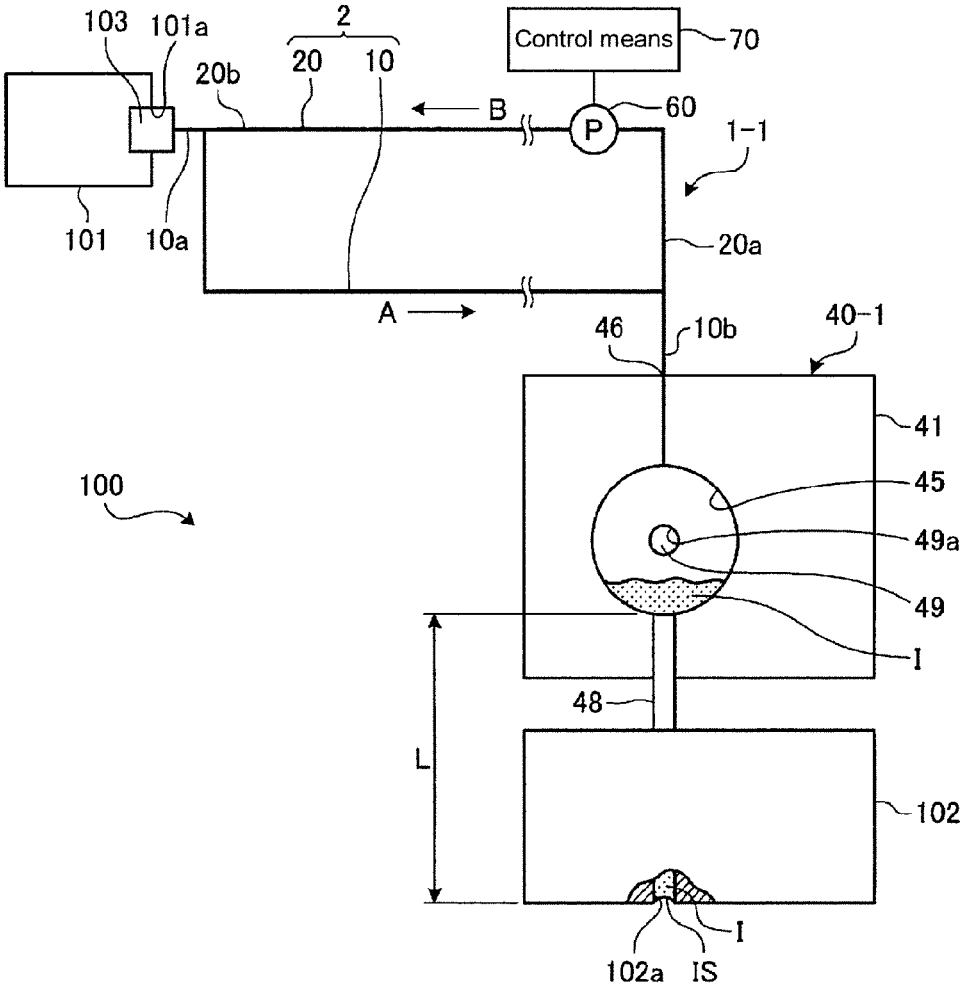
FIG. 15 is a view illustrating an example of a circulation mechanism having a damper according to a second modification of the second embodiment.

Hereinafter, a circulation mechanism according to a second modification of the second embodiment of the disclosure will be described in detail with reference to a drawing. FIG. 15 is a view illustrating an example of a circulation mechanism having a damper according to the second modification of the second embodiment. Also, in FIG. 15, parts identical to those of the second embodiment are denoted by the same reference symbols, and a description thereof is omitted.

In a circulation mechanism 1-1 according to the second modification of the second embodiment, as shown in FIG. 15, the ends 10*a* of the supply tubes 10 are directly connected to the supply ports 101*a* of the ink tanks 101, and the other ends 10*b* are directly connected to the ink inlets 46 of the damper 40-1. In the circulation mechanism 1-1 according to the second modification of the second embodiment, the ends 20*a* of the circulation tubes 20 are directly connected to the other ends 10*b* of the supply tubes 10, and the other ends 20*b* are directly connected to the ends 10*a* of the supply tubes 10 connected to the ink tanks 101. The circulation tubes 20 are installed in the inkjet printer 100 so as to be disposed above the supply tubes 10. In other words, the circulation mechanism 1-1 according to the second modification of the second embodiment is installed in the inkjet printer 100 such that the circulation tubes 20 are disposed above the supply tubes 10, and thus a direction in which the ink I flows during circulation is opposite to those of the second embodiment and the first modification.

An ink circulation method according to the above-described second modification of the second embodiment guides the ink I from the other ends 10*b* of the supply tubes 10 into the ink tanks 101, and performs circulation of the ink I when printing is stopped. Therefore, it is possible to use the sealing bodies 51 provided in the ink chambers 45 of the damper 40-1, in place of three-way valves, to circulate the ink I, and it is possible to reduce the cost.

[Third Modification of Second Embodiment]

Figure 16:
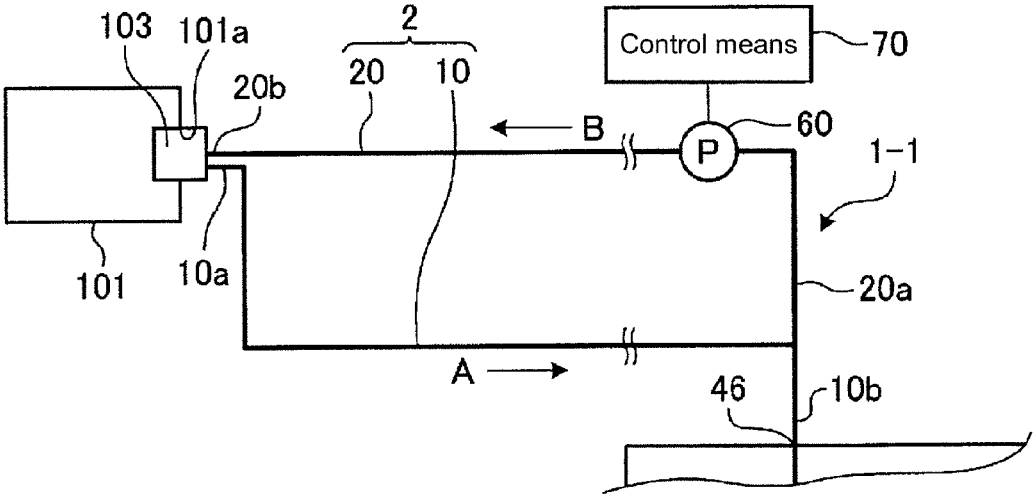
FIG. 16 is a view illustrating an example of amain part of a circulation mechanism having a damper according to a third modification of the second embodiment.

Hereinafter, a circulation mechanism according to a third modification of the second embodiment of the disclosure will be described in detail with reference to a drawing. FIG. 16 is a view illustrating an example of a main part of a circulation mechanism having a damper according to the third modification of the second embodiment. Also, in FIG. 16, parts identical to those of the second modification of the second embodiment are denoted by the same reference symbols, and a description thereof is omitted.

In a circulation mechanism 1-1 according to the third modification of the second embodiment, as shown in FIG. 16, the ends 10*a* of the supply tubes 10 are directly connected to the supply ports 101*a* of the ink tanks 101, and the other ends 10*b* are directly connected to the ink inlets 46 of the damper 40-1. In the circulation mechanism 1-1 according to the third modification of the second embodiment, the ends 20*a* of the circulation tubes 20 are directly connected to the other ends 10*b* of the supply tubes 10, and the other ends 20*b* are directly connected to the supply ports 101*a* of the ink tanks 101. The circulation tubes 20 are installed in the inkjet printer 100 so as to be disposed above the supply tubes 10. In other words, the circulation mechanism 1-1 according to the third modification of the second embodiment is installed in the inkjet printer 100 such that the circulation tubes 20 are disposed above the supply tubes 10, and thus a direction in which the ink I flows during circulation is opposite to those of the second embodiment and the first modification.

An ink circulation method according to the above-described third modification of the second embodiment guides the ink I from the other ends 10*b* of the supply tubes 10 into the ink tanks 101, and performs circulation of the ink I when printing is stopped. Therefore, it is possible to use the sealing bodies 51 provided in the ink chambers 45 of the damper 40-1, in place of three-way valves, to circulate the ink I, and it is possible to reduce the cost.

In the first embodiment, the second embodiment, and the like described above, during the standby state, the ink I is circulated between the head 102 and the ink tanks 101. However, in the disclosure, even when the ink I is ejected from the nozzles 102*a* of the head 102, that is, even during printing on a print medium, the pumps 60 may be driven such that the ink I is circulated between the head 102 and the ink tanks 101 in the circulation mechanism 1.

As described above, although the first embodiment, the second embodiment, and the like of the disclosure have been described, the disclosure is not limited to them. In the disclosure, the first embodiment, the second embodiment, and the like can be implemented in various other forms, and various changes such as omissions, substitutions, and combinations can be made without departing from the gist of the disclosure.

The invention claimed is:

1. A hydraulic head difference type damper for supplying ink supplied from an ink tank of an inkjet printer by a hydraulic head difference into a head for ejecting the ink, comprising:

a supply chamber configured to temporarily accommodate the ink;

an ink chamber connected to the supply chamber through a connection passage and configured to supply ink to the head; and an on-off valve including a sealing body for blocking the connection passage, a flexible film attached so as to cover the ink chamber from an outside, an opening body configured to open the sealing body in cooperation with the flexible film, and a biasing member for biasing the opening body toward the outside of the ink chamber, and configured to move the sealing body toward one side by the opening body, thereby opening the connection passage, as the flexible film bends toward an inside of the ink chamber against a biasing force of the biasing member, if the ink contained in the ink chamber decreases, and move the sealing body toward the other side, thereby blocking the connection passage, as the flexible film bends toward the outside of the ink chamber, if the ink contained in the ink chamber increases, wherein a guide port for guiding the ink to a circulation tube for circulating the ink between the ink chamber and the ink tank side is formed in the ink chamber.

2. The damper according to claim 1, wherein:

in a state where the damper has been installed in the inkjet printer, the guide port is disposed below an opening of the connection passage in the ink chamber.

3. The damper according to claim 1, wherein:

in a state where the damper has been installed in the inkjet printer, an ink inlet for receiving ink from the ink tank and guiding the received ink into the supply chamber, and an ink circulation port for guiding the ink guided from the guide port into the ink chamber into the circulation tube are formed in an upper surface.

4. An ink circulation method which is usable in an inkjet printer having an ink supply passage for storing ink and supplying ink of an ink tank to a head for ejecting, and having the ink tank, a damper, and a head disposed in this order from the upstream side toward the downstream side of the ink supply passage, and circulates the ink between the head side and the ink tank side, wherein:

the damper includes a supply chamber configured to temporarily accommodate the ink, an ink chamber connected to the supply chamber through a connection passage and configured to supply ink to the head, and an on-off valve including a sealing body for blocking the connection passage, a flexible film attached so as to cover the ink chamber from an outside, an opening body configured to open the sealing body in cooperation with the flexible film, and a biasing member for biasing the opening body toward the outside of the ink chamber, and configured to move the sealing body toward one side by the opening body, thereby opening the connection passage, as the flexible film bends toward an inside of the ink chamber against a biasing force of the biasing member, if the ink contained in the ink chamber decreases, and move the sealing body toward the other side, thereby blocking the connection passage, as the flexible film bends toward the outside of the ink chamber, if the ink contained in the ink chamber increases, and in a state where a nozzle of the head and a flow passage of the damper for supplying ink to the head are connected, the ink contained in the ink chamber is guided from a guide port separately disposed from the connection passage and formed in the ink chamber of the damper to one of a supply tube of the ink supply passage and the ink tank.

5. The ink circulation method according to claim 4, wherein:

the supply tube is directly connected to the ink tank and an ink inlet of the damper, and a circulation tube of the ink supply passage is directly connected to an ink circulation port of the damper and the supply tube, and a pump provided for the circulation tube is driven so as to maintain a meniscus surface of the ink formed at a leading end of the nozzle of the head.

6. The ink circulation method according to claim 5, wherein:

in a state where the damper has been installed in the inkjet printer, the circulation tube is disposed below the supply tube.

7. An ink circulation method which is usable in an inkjet printer having an ink supply passage for storing ink and supplying ink of an ink tank to a head for ejecting, and having the ink tank, a damper, and a head disposed in this order from the upstream side toward the downstream side of the ink supply passage, and circulates the ink between the head side and the ink tank side, wherein:

the damper includes a supply chamber configured to temporarily accommodate the ink, an ink chamber connected to the supply chamber through a connection passage and configured to supply ink to the head, and an on-off valve including a sealing body for blocking the connection passage, a flexible film attached so as to cover the ink chamber from an outside, an opening body configured to open the sealing body in cooperation with the flexible film, and a biasing member for biasing the opening body toward the outside of the ink chamber, and configured to move the sealing body toward one side by the opening body, thereby opening the connection passage, as the flexible film bends toward an inside of the ink chamber against a biasing force of the biasing member, if the ink contained in the ink chamber decreases, and move the sealing body toward the other side, thereby blocking the connection passage, as the flexible film bends toward the outside of the ink chamber, if the ink contained in the ink chamber increases, a circulation tube is connected to any one of an end portion of a supply tube of the ink supply passage positioned close to the damper on the upstream side from the damper, an end portion of the supply tube positioned close to the ink tank on the downstream side from the ink tank, and the ink tank, and when the sealing body blocks the connection passage, a pump is driven so as to circulate the ink between the supply tube and the circulation tube.

8. The ink circulation method according to claim 7, wherein:

the circulation tube is connected to the ink tank.

9. The ink circulation method according to claim 7, wherein:

the pump is driven such that a pressure of the ink in such a direction that the sealing body blocks the connection passage acts on the supply chamber.

10. The ink circulation method according to claim 7, wherein:

during printing of the inkjet printer, the supply tube supplies the ink from the ink tank into the head through the damper by a hydraulic head difference, and the pump is provided only for the circulation tube.

11. The ink circulation method according to claim 7, wherein:

when printing of the inkjet printer is stopped, the pump is driven so as to circulate the ink.

12. The damper according to claim 2, wherein:

in a state where the damper has been installed in the inkjet printer, an ink inlet for receiving ink from the ink tank and guiding the received ink into the supply chamber, and an ink circulation port for guiding the ink guided from the guide port into the ink chamber into the circulation tube are formed in an upper surface.

13. The ink circulation method according to claim 8, wherein:

during printing of the inkjet printer, the supply tube supplies the ink from the ink tank into the head through the damper by a hydraulic head difference, and the pump is provided only for the circulation tube.

14. The ink circulation method according to claim 9, wherein:

during printing of the inkjet printer, the supply tube supplies the ink from the ink tank into the head through the damper by a hydraulic head difference, and the pump is provided only for the circulation tube.

* * * * *